US005120638A

United States Patent [19]

Schmidt et al.

[11] Patent Number: 5,120,638

[45] Date of Patent: Jun. 9, 1992

[54] SILVER HALIDE EMULSION AND A PHOTOGRAPHIC MATERIAL

[75] Inventors: Wolfgang Schmidt; Hans-Jörg Metz, both of Cologne, Fed. Rep. of Germany

[73] Assignee: Agfa Gevaert Aktiengesellschaft, Leverkusen, Fed. Rep. of Germany

[21] Appl. No.: 579,871

[22] Filed: Sep. 7, 1990

[30] Foreign Application Priority Data

Sep. 22, 1989 [DE] Fed. Rep. of Germany ..... 3931629

[51] Int. Cl.[5] ..... G03C 1/035

[52] U.S. Cl. ..... 430/567; 430/569

[58] Field of Search ..... 430/567, 569

[56] References Cited

PUBLICATIONS

Klein, E., Metz. H. J.; Moisar, E. Zwillinsbildung bei AgBr-und AgCl-Kristallen in photographischen Emulsionen, Teil I, Photographic Korrespondenz, vol. 99, pp. 99-102, No. 7 (1963).

Klein, E.; Metz, H. J.; Moisar, E. Zwillingsbildung bei AgBr-und AgCl-Kristallen in Photographischen Emulsionen, Teil II, Photographic Korrespondenz, vol. 100, Pp. 55-69, No. 4 (1964).

*Primary Examiner*—Charles L. Bowers, Jr.
*Assistant Examiner*—Janet C. Baxter
*Attorney, Agent, or Firm*—Connolly & Hutz

[57] ABSTRACT

A photographic silver halide emulsion, of which at least 50% by weight of the silver halide crystals are triply twinned crystals with a crystal structure consisting of a basic tetrehedron with [111]-faces and three identical twinned regions, each of which has a [111]-twin face in common with the basic tetrahedron and is outwardly bounded by three [100]-faces and one [111]-face or by four [100]-faces, and of which any two respective regions are connected to each other by a common [411]-twin face, and whose grain size distribution has a coefficient of variation of at most 20%, is suitable for the production of photographic materials having high sensitivity, high contrast and very high developability.

8 Claims, 6 Drawing Sheets

SILVER HALIDE EMULSION AND A PHOTOGRAPHIC MATERIAL

The invention relates to a novel silver halide emulsion and a photographic material which contains the novel silver halide emulsion in at least one light-sensitive layer.

For photographic emulsions, it is frequently desirable for the silver halide microcrystals contained therein to be uniform with respect to grain shape and grain size. In fact, a higher contrast can be achieved with such homogeneous crystals than with crystals having a broad grain size and grain shape distribution.

Furthermore, it is often desirable for the emulsion microcrystals to have twin planes. Twin planes in silver halide crystals are stacking faults in the crystal lattice, as described, for example, in the paper by E. Klein et al. in "Photographische Korrespondenz", volume 99 (1963), page 99.

Owing to the randomness of the formation of stacking faults during the formation phase of the silver halide microcrystals, it has not been possible hitherto to produce emulsions which contain twinned microcrystals with uniform grain shape and grain size.

An emulsion has accordingly been found which contains up to over 50% by weight, preferably over 90% by weight of emulsion microcrystals of a given, triply twinned crystal type and also has a very narrow distribution of microcrystals. The grain shape of the grains of this emulsion was described for the first time in FIG. 26 (Type lk) of the paper by E. Klein, H. J. Metz and E. Moisar in "Photographische Korrespondenz", volume 100 (1964), page 65.

This twin type lk is described in more detail in the following Figures.

Figure 1A:
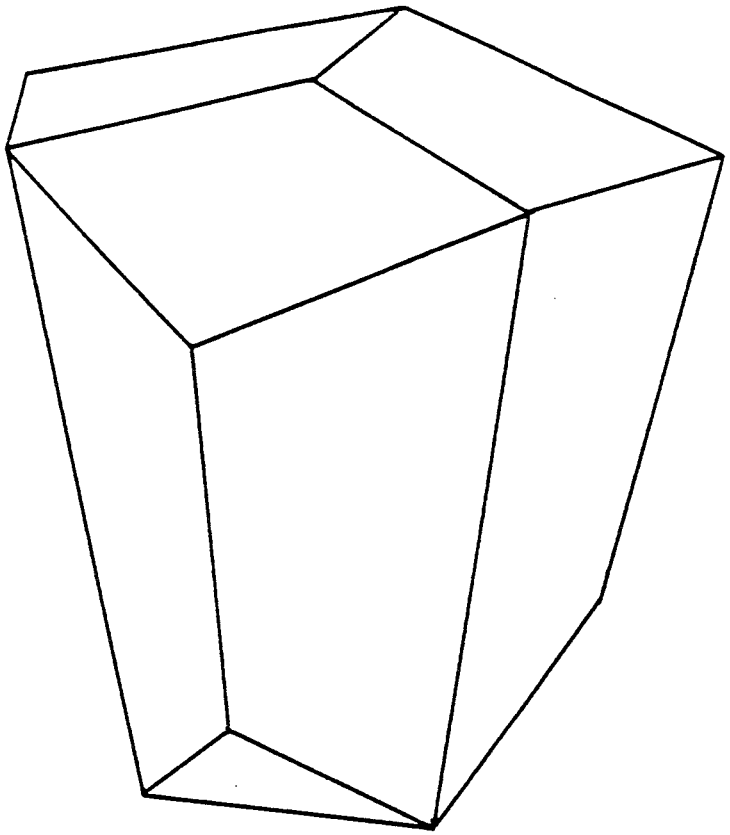
Figure 1B:
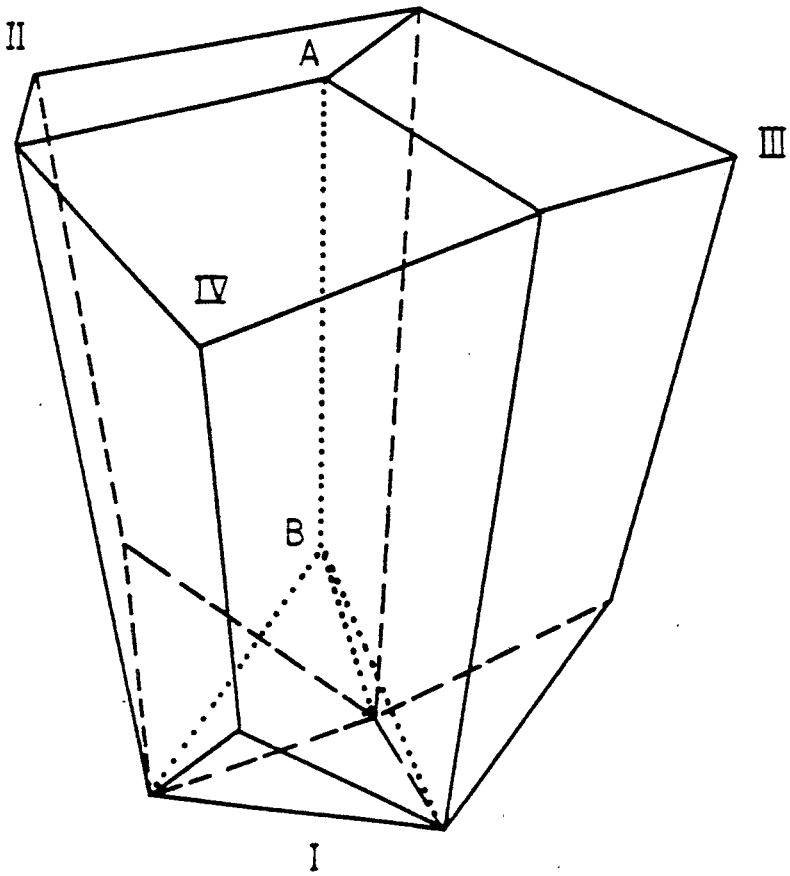

FIG. 1*a* shows the external shape of such a crystal standing on its base at a certain angle of view. FIG. 1*b* also shows the non visible edge lines in this direction of view (long-dashed line) and the internal boundary lines of the individual twinned regions located inside the crystal (short-dashed line).

The crystal type consists of a total of four different twinned regions. The straight line determined by the points A and B in FIG. 1*b* is a threefold axis of symmetry for the entire crystal.

Figure 2:
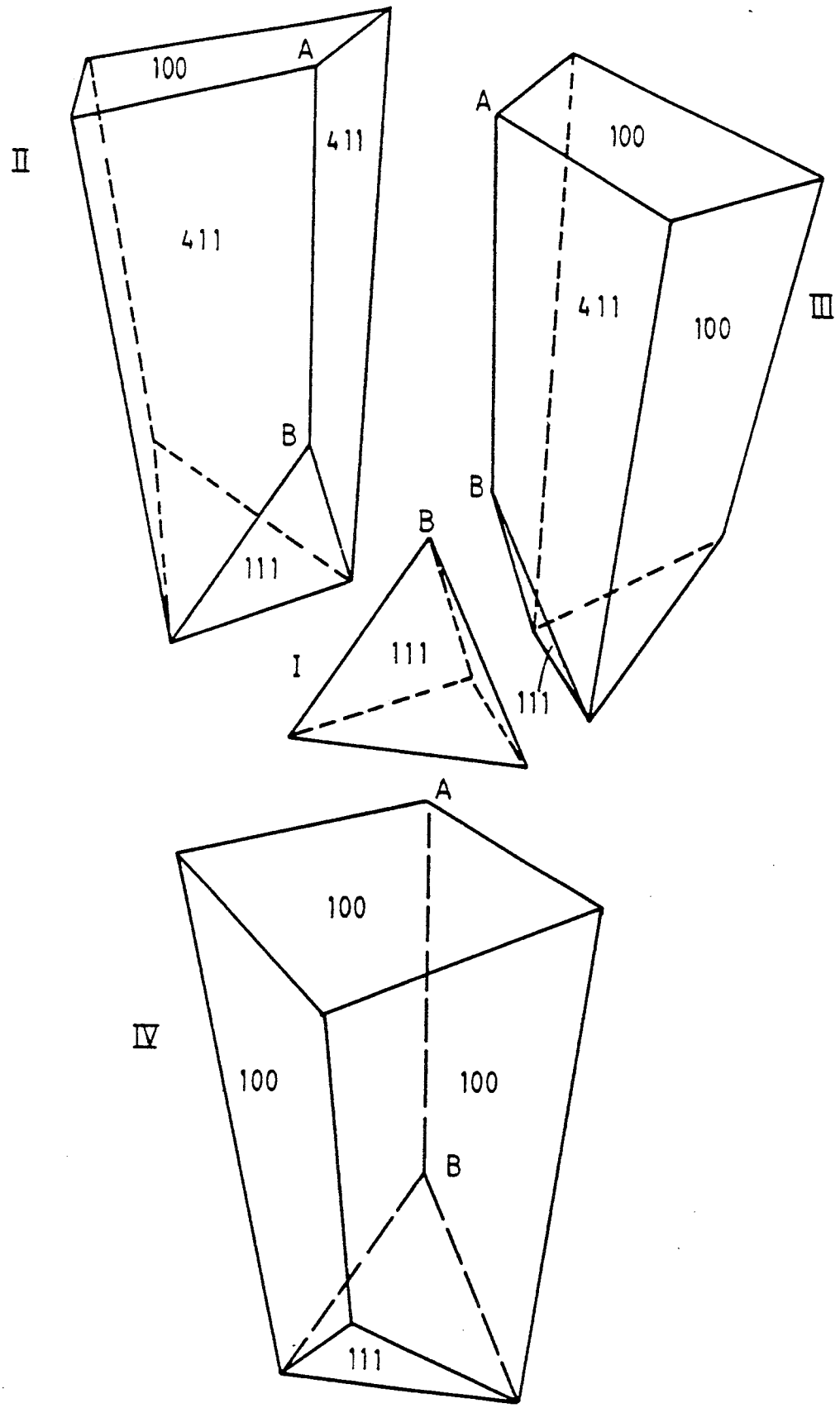

The individual twinned regions have been shown separately in the same orientation in FIG. 2. This drawing also shows the crystallographic indices for the faces which are visible in each case.

The "core" of the twin type lk is formed by a tetrahedron (I). The base of the tetrahedron (equilateral triangle) is at the same time the base of the entire crystal. It is a [111] face. Three identical twinned regions (II, III, IV) which each have a [111] twin face in common with one of the three lateral faces of the basic tetrahedron are grouped round the basic tetrahedron. With this type, the crystal regions II, III, IV are each bounded outwardly by three [100] faces and one [111] face or by four [100] faces. Any two of these regions have one [411] twin plane in common.

Figure 3A:
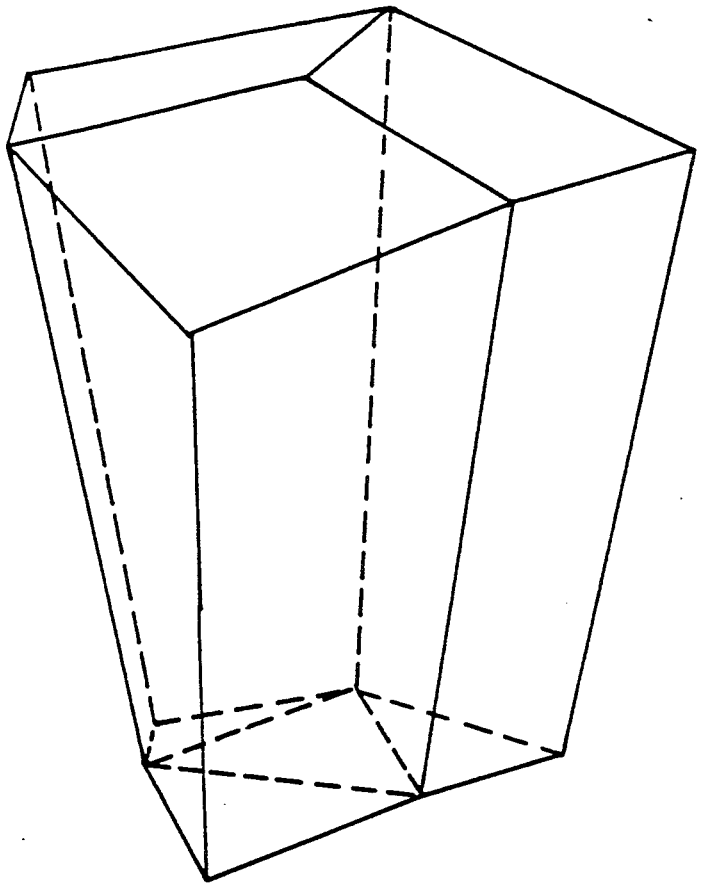
Figure 3B:
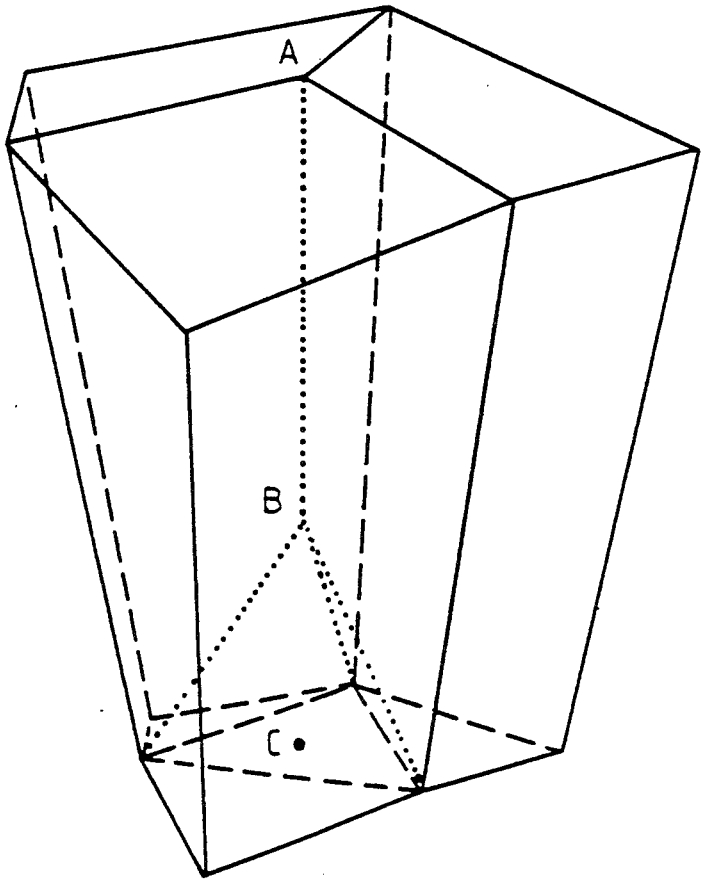

FIG. 3 shows a different form of said twin type in which the regions II, III, IV are bounded by four [100] faces. FIG. 3*a* illustrates the external shape of this crystal type. In FIG. 3*b*, the internal boundary lines of the individual twinned regions have been entered into this pattern.

Different shapes of the existing crystal type can also be obtained if the ratio of the overall crystal height H (distance AC between the base of the basic tetrahedron and the vertex A) to the height of the basic tetrahedron h (distance BC between the base of the basic tetrahedron and the vertex B) is changed. The ratio H/h has the value 3 in FIG. 3.

Figure 4A:
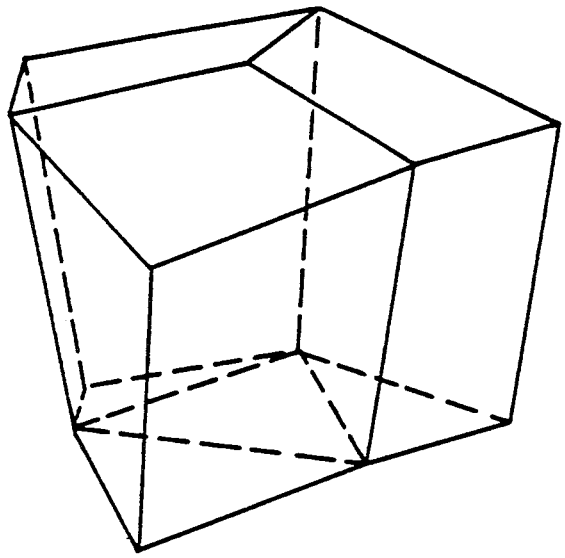
Figure 4B:
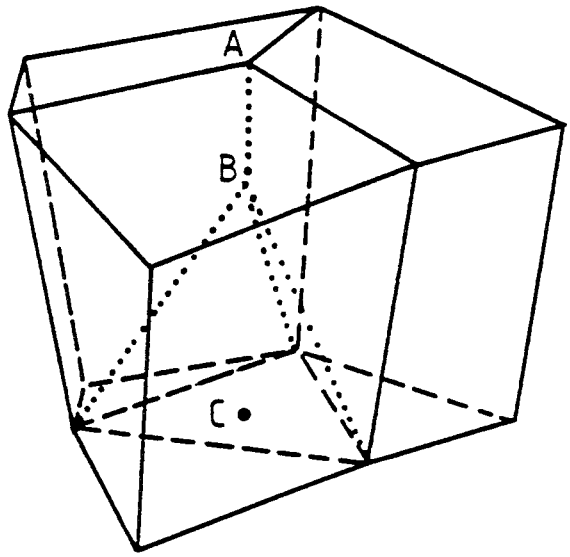

The value 1.5 has been selected for this ratio in FIG. 4.

Emulsions in which H/h ranges from 1 to 5, in particular 1.5 to 3, are preferred.

The basic [111] face of the basic tetrahedron can be an outer face (FIG. 1–4) or can be overgrown by a triangular pyramid with [100] faces.

Figure 5A:
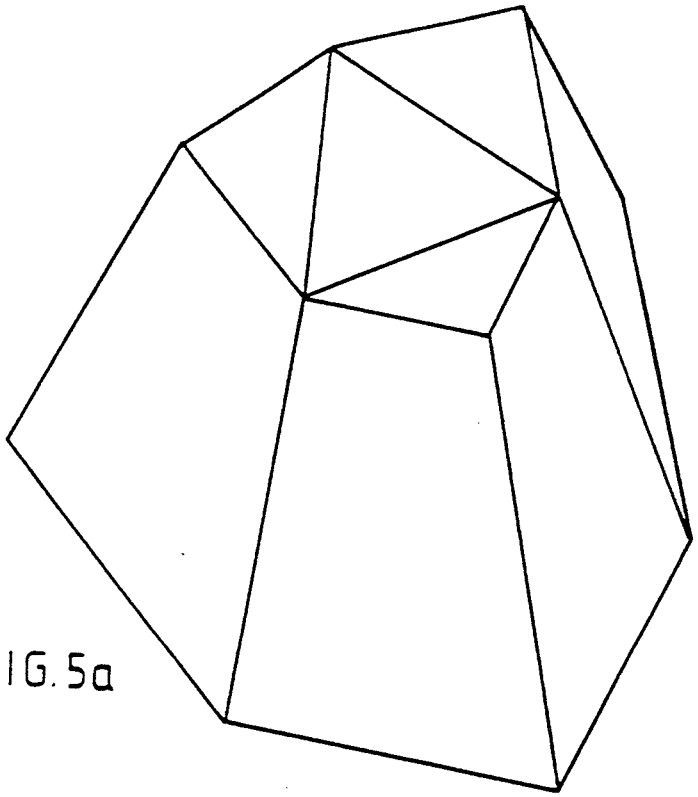
Figure 5B:
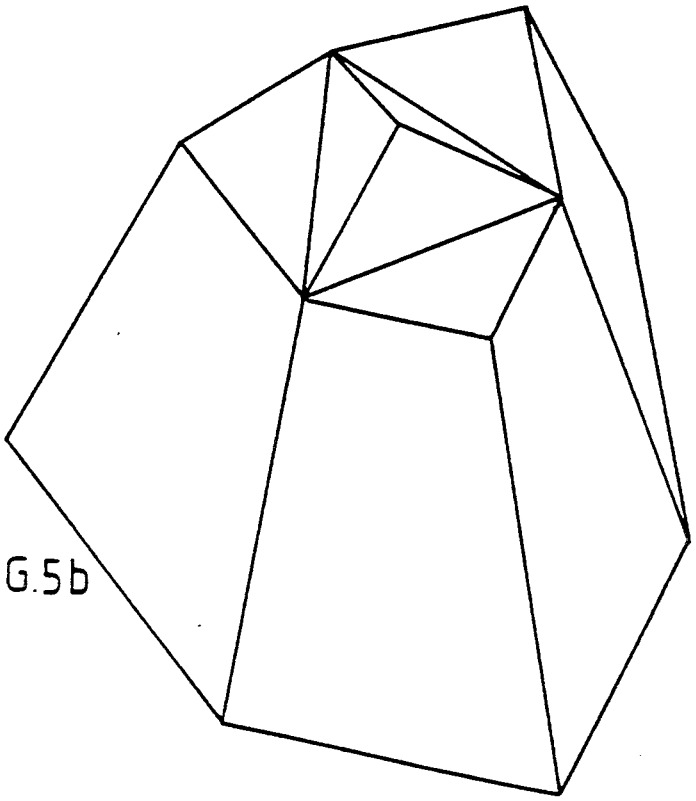

FIG. 5*a* shows the basic [111] face of the basic tetrahedron on top of the crystal; in FIG. 5*b*, this face is overgrown by the triangular pyramid with [100] faces.

Figure 6:
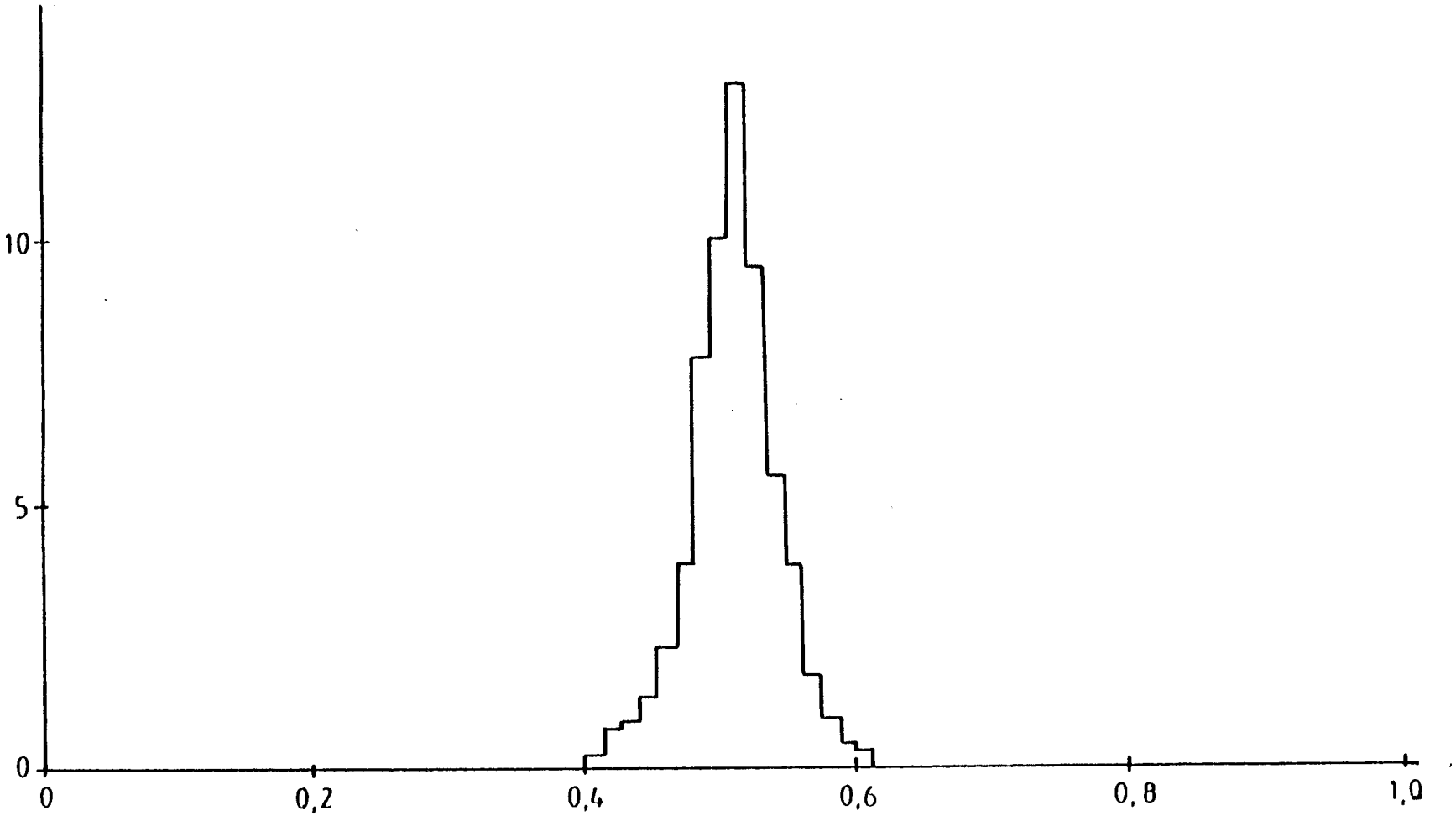

The grain size distribution of an emulsion according to the invention is shown in FIG. 6 (see Example 1).

The invention accordingly relates to a photographic silver halide emulsion, of which at least 50% by weight, preferably at least 90% by weight of the silver halide crystals are triply twinned crystals having the specified structure and of which the grain size distribution has a coefficient of variation of at most 20.

The production of the silver halide emulsion according to the invention is characterised, in particular, by a short nucleation phase, prolonged physical ripening and subsequent precipitation of further silver halide onto the nuclei, nucleation and further precipitation being carried out by the double jet process.

Nucleation, which is of great importance for the desired grain shape, is carried out at a pAg of 5.5 to 6.5, a pH below 4 and a temperature of between 20° and 50° C. with vigorous stirring. Acidly treated pig hide gelatin is preferably used as hydrophilic colloid. The nucleation time is one minute at maximum.

Physical ripening is carried out at a pH above 4.0, a pAg of 6.0 to 7.0 and a temperature between 60° and 80° C. and lasts at least 60 minutes, preferably 90 to 180 minutes.

Precipitation after nucleation takes place at a pAg of 6.0 to 7.0, a pH of 4.0 to 8.0 and a temperature of 20° to 50° C. The precipitation is not critical and is preferably 10 to 60 minutes. Any grain sizes, preferably between 0.3 and 2.0 μm, can be produced by varying the quantities of silver salt and halide in the precipitation stage. The halide composition (AgCl, AgBrCl, AgBr, AgIBr, AgIBrCl) can also be selected as desired in this stage, while pure AoBr is preferred for the nucleation phase.

The emulsions according to the invention show high sensitivity, high contrast and very good developability when used as a component of photographic materials.

The coefficient of variation is defined by:

$$\frac{S}{r}$$

S=standard deviation of the grain size distribution;
r=average grain diameter;
$r_i$=grain diameter of grains; of size class i
$n_i$=number of grains. In size class i The term grain diameter denotes the diameter of the sphere having a volume equal to the grain.

$$S = \Sigma \frac{(r - r_i)^2 ni}{n_i}$$

-continued $$r = \Sigma \frac{n_i r_i}{n_i}$$

The invention therefore also relates to a photographic material consisting of a substrate and at least one light-sensitive silver halide emulsion layer which is applied thereto and contains the emulsion according to the invention.

The photographic material can be, for example, a black/ white photographic material, an X-ray material or a colour photographic material. It is preferably a colour photographic material.

Examples of colour photographic materials include colour negative films, colour reversal films, colour positive films, colour photographic paper, colour reversal photographic paper, colour-sensitive materials for the colour diffusion transfer process or the silver colour bleaching process.

Suitable substrates for the production of colour photographic materials include, for example, films and foils of semi-synthetic and synthetic polymers such as cellulose nitrate, cellulose acetate, cellulose butyrate, polystyrene, polyvinylchloride, polyethyleneterephthalate and polycarbonate and paper laminated with a baryta layer or $\alpha$-olefin polymer layer (for example polyethylene). These substrates can be coloured with dyes and pigments, for example titanium dioxide. They can also be coloured black to act as a screen from light. The surface of the substrate is generally subjected to a treatment designed to improve the adhesion of the photographic emulsion layer, for example corona discharge with subsequent application of a substrate layer.

The colour photographic materials usually contain at least one respective red-sensitive, green-sensitive and blue-sensitive silver halide emulsion layer and optionally intermediate layers and protective layers.

Essential components of the photographic emulsion layers include binders, silver halide particles and colour couplers.

Gelatin is preferably used as binder. However, it can be replaced completely or partially by other synthetic, semi-synthetic or also naturally occurring polymers. Synthetic gelatin substitutes include, for example, polyvinylalcohol, poly-N-vinylpyrrolidone, polyacrylamides, polyacrylic acid and derivatives thereof, in particular the mixed polymers thereof. Naturally occurring gelatin substitutes include, for example, other proteins such as albumin or casein, cellulose, sugar, starch or alginates. Semi-synthetic gelatin substitutes are generally modified natural products. Cellulose derivatives such as hydroxyalkylcellulose, carboxymethylcellulose and phthalylcellulose as well as gelatin derivatives obtained by reaction with alkylation or acylation agents or by grafting on of polymerisable monomers are examples of them.

The binders should have an adequate quantity of functional groups so that sufficiently resistant layers can be produced by reaction with suitable hardening agents. Such functional groups include, in particular, amino groups, but also carboxyl groups, hydroxyl groups and active methylene groups.

The gelatin preferably used can be obtained by acidic or alkaline decomposition. Oxidised gelatin can also be used. As mentioned, acidly ashed pig hide gelatin is preferably used for the silver halide emulsion according to the invention.

The production of such gelatins is described, for example, in The Science and Technology of Gelatine, edited by A. G. Ward and A. Courts, Academic Press 1977, page 295 et seq. The gelatin used in each case should have as low as possible a content of photographically active impurities (inert gelatin). High viscosity gelatins with a low swelling capacity are particularly advantageous.

The silver halide present in the photographic material as light-sensitive component can contain, as halide, chloride, bromide or iodide or mixtures thereof. For example, the halide content of at least one layer can consist of 0 to 15 mole-% of iodide, 0 to 100 mole-% of chloride and 0 to 100 mole-% of bromide. In addition to the grain shape according to the invention, predominantly compact crystals which are, for example, regularly cubic or octahedric or can have transitional shapes can be used. However, platelet shaped crystals can preferably also be present, of which the average diameter to thickness ratio is preferably at least 5:1, the diameter of a grain being defined as the diameter of a circle with a circle content corresponding to the projected face of the grain. However, the layers can also have table-shaped silver halide crystals in which the diameter to thickness ratio is substantially higher than 5:1, for example is 12:1 to 30:1. However, at least one silver halide emulsion layer must contain a silver halide emulsion according to the claims.

The silver halide grains can also have a multi-layered grain structure, in the simplest case with an inner and an outer grain region (core/shell), the halide composition and/or other modifications such as doping of the individual grain regions differing. The average grain size of the emulsions is preferably between 0.2 $\mu$m and 2.0 $\mu$m and the grain size distribution can be both homogeneous and heterogeneous. Homogeneous grain size distribution means that 95% of the grains deviate from the average grain size by not more than $\pm$30%. In addition to the silver halide, the emulsions can also contain organic silver salts, for example silver benztriazolate or silver behenate.

Two or more types of silver halide emulsions which are produced separately can be used as a mixture.

The photographic emulsions not corresponding to the invention can be produced from soluble silver salts and soluble halides by various methods (for example P. Glafkides, Chimie et Physique Photographique, Paul Montel, Paris (1967), G. F. Duffin, Photographic Emulsion Chemistry, The Focal Press, London (1966), V. L. Zelikman et al, Making and Coating Photographic Emulsion, The Focal Press, London (1966)).

The silver halide is preferably precipitated in the presence of the binder, for example the gelatin, and can be carried out in the acidic, neutral or alkaline pH range, silver halide complex forming agents preferably also being used. They include, for example, ammonia, thioether, imidazole, ammoniumthiocyanate or excess halide. The water-soluble silver salts and the halides are brought together selectively in succession by the single-jet or, at the same time, by the double-jet process or by any combination of the two processes. Metering is preferably carried out at increasing feed rates, and the "critical" supply rate at which no further new nuclei are formed should not be exceeded. The pAg range can vary within wide limits during precipitation, the so-called pAg-controlled process preferably being employed, in which a given pAg value is kept constant or a defined pAg profile is maintained during precipitation. In addition to the preferred precipitation with excess halide, however, so-called reverse precipitation is also possible with excess silver ions. In addition to precipitation, the silver halide crystals can also grow by physical ripening (Ostwald ripening), in the presence of excess halide and/or silver halide complexing agents. The growth of the emulsion grains can even take place predominantly by Ostwald ripening, a fine-grained so-called Lippmann emulsion preferably being mixed with a difficultly soluble emulsion and being dissolved and allowed to crystallise thereon.

Salts or complexes of metals, such as Cd, Zn, Pb, Tl, Bi, Ir, Rh, Fe can also be present during precipitation and/or physical ripening of the silver halide grains.

Precipitation can also be carried out in the presence of sensitizing dyes. Complexing agents and/or dyes can be rendered ineffective at any desired moment, for example by changing the pH or by an oxidation treatment.

After completion of crystallisation or even at an earlier moment, the soluble salts are removed from the emulsion, for example by noodle formation and washing, by flocculation and washing, by ultra-filtration or by ion exchangers.

The silver halide emulsion is generally subjected to chemical sensitization under defined conditions—pH, pAg, temperature, gelatin concentration, silver halide concentration and sensitizer concentration—until the optimum sensitivity and fogging are achieved. The mode of operation is described, for example, in H. Frieser "Die Grundlagen der Photographischen Prozesse mit Silberhalogeniden" page 675-734, Akademische Verlagsgesellschaft (1968).

Chemical sensitization can be carried out with addition of compounds of sulphur, selenium, tellurium and/or compounds of metals from Group VIII of the periodic system (for example gold, platinum, palladium, iridium), moreover thiocyanate compounds, surface-active compounds such as thioethers, heterocyclic nitrogen compounds (for example imidazoles, azaindenes) or also spectral sensitizers (described, for example, by F. Hamer "The Cyanine Dyes and Related Compounds", 1964 and Ullmanns Encyclopadie der technischen Chemie, 4th edition, volume 18, page 431 et seq. and Research Disclosure No. 17643, section III) can be added. Alternatively or additionally, reduction sensitization can be carried out with addition of reducing agents (tin-II-salts, amines, hydrazine derivatives, aminoboranes, silanes, formamidine sulphinic acid) using hydrogen, low pAg (for example, below 5) and/or high pH (for example, above 8).

The photographic emulsions can contain compounds for preventing fogging or for stabilising the photographic function during production, storage or photographic processing.

Azaindenes, preferably tetra- and pentaazaindenes are particularly suitable, in particular those which are substituted with hydroxyl or amino groups. Such compounds have been described, for example, by Birr, Z. Wiss. Phot. 47 (1952), pages 2-58. Salts of metals such as mercury or cadmium, aromatic sulphonic or sulphinic acids such as benzolsulphinic acid or nitrogen-containing heterocycles such as nitrobenzimidazole, nitroindazole, optionally substituted benztriazoles or benzthiazolium salts can also be used as anti-fogging agents. Heterocycles containing mercapto groups, for example mercaptobenzthiazoles, mercaptobenzimidazoles, mercaptotetrazoles, mercaptothiadiazoles, mercaptopyrimidines are particularly suitable, and these mercaptoazoles can also contain a water-solubilizing group, for example a carboxyl group or sulpho group. Other suitable compounds are published in Research Disclosure No. 17643 (1978), section VI.

The stabilisers can be added to the silver halide emulsions before or after the ripening thereof. The compounds can obviously also be added to other photographic layers which are associated with a silver halide layer.

Mixtures of two or more of the above-mentioned compounds can also be used.

The photographic emulsion layers or other hydrophilic colloid layers of the light-sensitive material produced according to the invention can contain surface-active agents for various purposes, such as coating auxiliaries for preventing electrical charging, for improving the sliding properties, for emulsifying the dispersion, for preventing adhesion and for improving the photographic characteristics (for example, development acceleration, high contrast, sensitization, etc.). In addition to natural surface-active compounds, for example saponin, synthetic surface-active compounds (surfactants) are predominantly used: non-ionic surfactants, for example alkylene oxide compounds, glycerin compounds or glycidol compounds, cationic surfactants, for example higher alkylamines, quaternary ammonium salts, pyridine compounds and other heterocyclic compounds, sulphonium compounds or phosphonium compounds, anionic surfactants containing an acid group, for example carboxylic acid, sulphonic acid, a phosphoric acid, sulphuric acid ester or phosphoric acid ester group, ampholytic surfactants, for example amino acid and aminosulphonic acid compounds as well as sulphur or phosphoric acid esters of an aminoalcohol.

The photographic emulsions can be spectrally sensitized using methine dyes or other dyes. Cyanine dyes, merocyanine dyes and complex merocyanine dyes are particularly suitable dyes.

Research Disclosure 17643/1978, section IV, contains a survey of the polymethine dyes which are suitable as spectral sensitizers, suitable combinations thereof and super-sensitizing combinations.

The following dyes are particularly suitable—ordered according to regions of the spectrum:

1. as red sensitizers 9-ethylcarbocyanines with benzthiazole, benzselenazole or naphthothiazole as basic end groups which can be substituted in the 5- and/or 6-position by halogen, methyl, methoxy, carbalkoxy, aryl as well as 9-ethylnaphthoxathia- and -selenium carbocyanines and 9-ethylnaphthothiaoxa- and -benzimidazocarbocyanines, providing that the dyes carry at least one sulphoalkyl group at the heterocyclic nitrogen.

2. as green sensitizers 9-ethylcarbocyanines with benzoxazole, naphthoxazole or a benzoxazole and a benzthiazole as basic end groups as well as benzimidazocarbocyanines which can also be further substituted and also have to contain at least one sulphoalkyl group at the heterocyclic nitrogen.

3. as blue sensitizers symmetrical or asymmetrical benzimidazo-, oxa-, thia- or selena- cyanines containing at least one sulphoalkyl group at the heterocyclic nitrogen and optionally further substituents at the aromatic core, as well as apomerocyanines containing a rhodanine group.

The red sensitizers RS, green sensitizers GS and blue sensitizers BS listed below, which can each be used individually or in combination with one another, for example RS 1 and RS 2, as well as GS1 and GS2 are mentioned as examples, in particular for negative and reversal film.

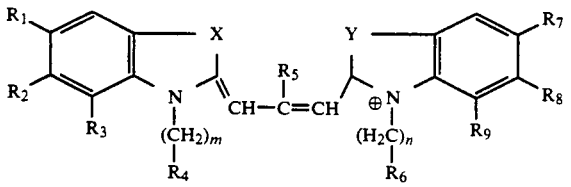

RS 1: $R_1$, $R_3$, $R_7$, $R_9$=H; $R_2$, $R_8$=Cl; $R_4$=$SO_3\ominus\oplus NH(C_2H_5)_3$; $R_5$=$C_2H_5$; $R_6$=$SO_3\ominus$; m, n=3; X, Y=S;

RS 2: $R_1$, $R_3$, $R_9$=H; $R_2$=Phenyl; $R_4$=

$$-\underset{\underset{CH_3}{|}}{CH}-SO_3\ominus K\oplus;$$

$R_5$=$C_2H_5$; $R_6$=$SO_3\ominus$; $R_7$, $R_8$=—$OCH_3$; m=2; n=3; X=O; Y=S;

RS 3: $R_1$, $R_9$=H; $R_2$, $R_3$ together —CH=CH—CH=CH—; $R_4$=$SO_3\ominus Na\oplus$; $R_5$=$C_2H_5$; $R_6$=$SO_3\ominus$; $R_7$, $R_8$=Cl; m, n=3; X=S; Y=N—$C_2H_5$;

RS 4: $R_1$=$OCH_3$; $R_2$, $R_8$=$CH_3$; $R_3$, $R_4$, $R_7R_9$=H; $R_5$=$C_2H_5$; $R_6$=$SO_3\ominus$; m=2; n=4; X=S; Y=Se;

RS 5: $R_1$, $R_7$=H; $R_2$, $R_3$ and $R_8$, $R_9$ together —CH=CH—CH=CH—; $R_4$=$SO_3\ominus\oplus NH(C_2H_5)_3$; $R_5$=$C_2H_5$; $R_6$=$SO_3\ominus$; m=2; n=3; X, y=S;

GS 1: $R_1$, $R_3$, $R_7$, $R_9$=H; $R_2$=Phenyl; $R_4$=

$$\underset{\underset{CH_3}{|}}{CH}-SO_3\ominus\overset{\oplus}{N}H(C_2H_5)_3;$$

$R_5$=$C_2H_5$; $R_6$=$SO_3\ominus$; $R_8$=Cl; m=2; n=3; X, y=O;

GS 2: $R_1$, $R_2$, $R_7$, $R_8$=Cl; $R_3$, $R_5$, $R_6$, $R_9$=H; $R_4$=

$$-\underset{\underset{CH_3}{|}}{CH}-SO_3\ominus;$$

m, n=1; X, Y=N—$C_2H_5$;

GS 3: $R_1$, $R_7$=H; $R_2$, $R_3$ and $R_8$, $R_0$ together —CH=CH—CH=CH—; $R_4$=$SO_3\ominus Na\oplus$; $R_5$=$C_2H_5$; $R_6$=$SO_3\ominus$; m, n=3; X, Y=O;

GS 4: $R_1R_3$, $R_4R_7$, $R_8$, $R_9$=H; $R_2$=$OCH_3$; $R_5$=$C_2H_5$; $R_6$=$SO_3\ominus$; m=2; n=4; X=O, Y=S;

BS 1:

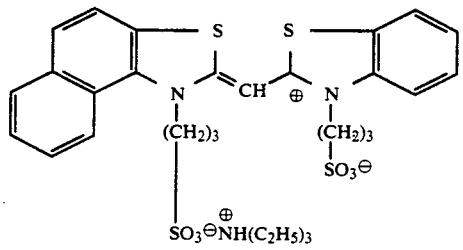

-continued

BS 2:

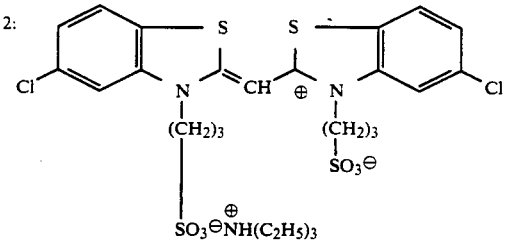

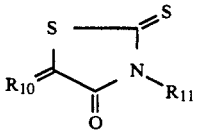

BS 3: $R_{10}$ =

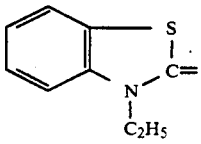

;

$R_{11}$ = —$CH_2$—COOH

BS 4: $R_{10}$ =

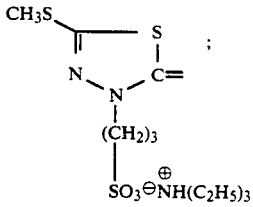

;

$R_{11}$ = $C_2H_5$

BS 5: $R_{10}$ =

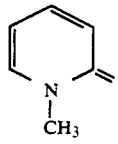

;

$R_{11}$ = $C_2H_5$

Sensitizers can be omitted if the inherent sensitivity of the silver halide is adequate for a given region of the spectrum, for example the blue sensitivity of silver bromides.

Non-diffusing monomeric or polymeric colour couplers which can be located in the same layer or in a layer adjacent thereto are not included among the emulsion layers which are sensitized in different ways. Cyan couplers are usually allocated to the red-sensitive layers, magenta couplers to the green-sensitive layers and yellow couplers to the blue-sensitive layers.

Colour couplers for producing the cyan partial colour image are generally couplers of the penol or α-naphthol type; suitable examples thereof includes:

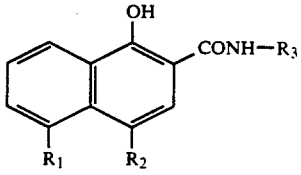

BG 1: $R_1$=H; $R_2$=H; $R_3$=

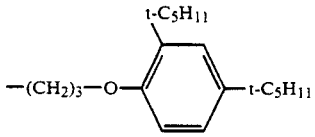

BG 2: $R_1$=—NHCOOCH$_2$—CH(CH$_3$)$_2$; $R_2$=H; $R_3$=—(CH$_2$)$_3$—OC$_{12}$H$_{25}$

BG 3: $R_1$=H; $R_2$=—OCH$_2$—CH$_2$—SO$_2$CH$_3$; $R_3$=C$_{16}$H$_{33}$

BG 4: $R_1$=H; $R_2$=—OCH$_2$—CONH—(CH$_2$)$_2$—OCH$_3$; $R_3$=

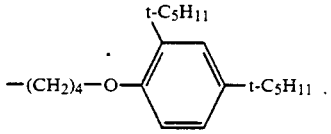

BG 5: $R_1$=H; $R_2$=H; $R_3$=

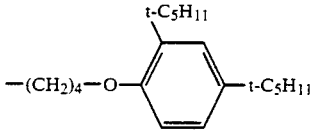

BG 6: $R_1$=H; $R_2$=H; $R_3$=

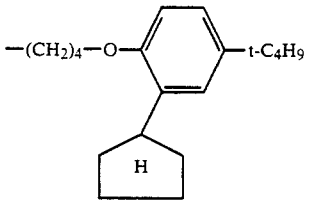

BG 7: $R_1$=H; $R_2$=Cl; $R_3$=—C(C$_2$H$_5$)$_2$—(CH$_2$)$_{20}$—CH$_3$

BG 8: $R_1$=H; $R_2$=—O—CH$_2$—CH$_2$—S—CH(COOH)—C$_{12}$H$_{25}$ $R_3$=Cyclohexyl

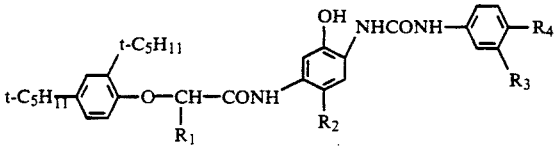

BG 9: $R_1$=—C$_4$H$_9$; $R_2$=H; $R_3$=—CN; $R_4$=Cl

BG 10: $R_1$=—C$_4$H$_9$; $R_2$=H; $R_3$=H; $R_4$=—SO$_2$CHF$_2$

BG 11: $R_1$=—C$_4$H$_9$; $R_2$—

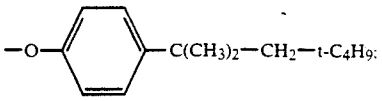

$R_3$=H; $R_4$=—CN

BG 12: $R_1$=C$_2$H$_5$; $R_2$=H; $R_3$=H; $R_4$=—SO$_2$CH$_3$

BG 13: $R_1$=—C$_4$H$_9$; $R_2$=H; $R_3$=H; $R_4$=—SO$_2$—C$_4$H$_9$

BG 14: $R_1$=—C$_4$H$_9$; $R_2$=H; $R_3$=—CH; $R_4$=—CN

BG 15: $R_1$=—C$_4$H$_9$; $R_2$=H; $R_3$=H; $R_4$=—SO$_2$—CH$_2$—CHF$_2$

BG 16: $R_1$=—C$_2$H$_5$; $R_2$=H; $R_3$=H; $R_4$=—SO$_2$CH$_2$—CHF—C$_3$H$_7$

BG 17: $R_1$=—C$_4$H$_9$; $R_2$=H; $R_3$=H; $R_4$=F

BG 18: $R_1$=—C$_4$H$_9$; $R_2$=H; $R_3$=H; $R_4$=—SO$_2$CH$_3$

BG 19: $R_1$=—C$_4$H$_9$; $R_2$=H; $R_3$=H; $R_4$=—CN

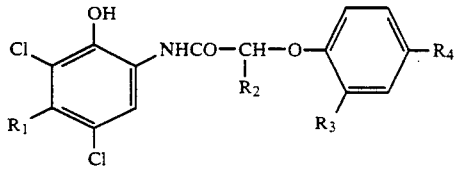

BG 20: $R_1$=—CH$_3$; $R_2$=—C$_2$H$_5$; $R_3$, $R_4$=—t—C$_5$H$_{11}$

BG 21: $R_1$=—CH$_3$; $R_2$=H; $R_3$, $R_4$=—t—C$_5$H$_{11}$

BG 22: $R_1$=—C$_2$H$_5$; $R_2$=—C$_2$H$_5$; $R_3$, $R_4$=—t—C$_5$H$_{11}$

BG 23: $R_1$=—C$_2$H$_5$; $R_2$=—C$_4$H$_9$; $R_3$, $R_4$=—t—C$_5$H$_{11}$

BG 24: $R_1$=—C$_2$H$_5$; $R_2$=—C$_4$H$_9$; $R_3$, $R_4$=—t—C$_4$H$_9$

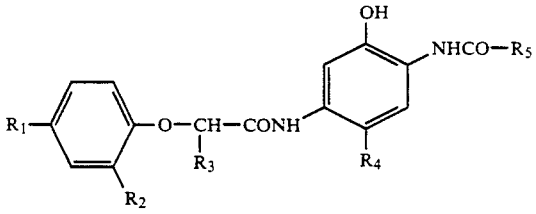

BG 25: $R_1$, $R_2$=—t—C$_5$H$_{11}$; $R_3$=—C$_4$H$_9$; $R_4$=H; $R_5$=—C$_3$F$_7$

BG 26: $R_1$=—NHSO$_2$—C$_4$H$_9$; $R_2$=H; $R_3$=—C$_{12}$H$_{25}$; $R_4$=Cl; $R_5$=Phenyl BG 27: $R_1$, $R_2$=—t—C$_5$H$_{11}$; $R_2$=Cl, $R_3$=—CH(CH$_3$)$_2$; $R_4$=Cl; $R_5$=Pentafluorophenyl BG 28: $R_1$=—t—C$_5$H$_{11}$; $R_2$=Cl; $R_3$=—C$_6$H$_{13}$; $R_4$=Cl. $R_5$=—2—Chlorophenyl Colour couplers for producing the magenta partial colour image are generally couplers of the 5-pyraxolone, indazolone or pyrazoloazole type; suitable examples thereof include:

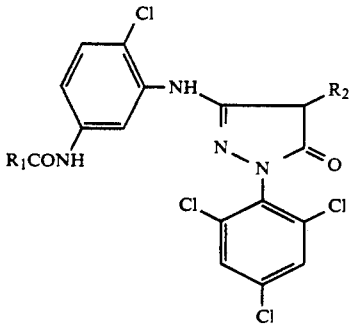
PP 1: $R_1$ = 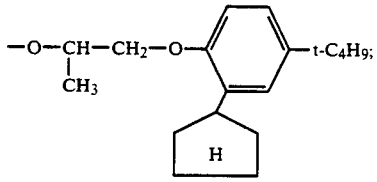 $R_2$ = H
PP 2: $R_1$ = 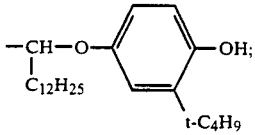 $R_2$ = H
PP 3: $R_1$ = $C_{13}H_{27}$; $R_2$ = H
PP 4: $R_1$ = $-O-C_{16}H_{33}$; $R_2$ = H
PP 5: $R_1$ $-C_{13}H_{27}$; $R_2$ = 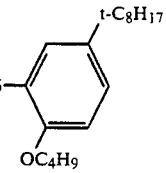
PP 6: $R_1$ 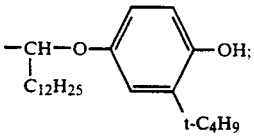 $R_2$ = 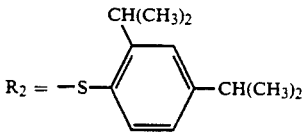
PP 7: $R_1$ = $-C_9H_{19}$; $R_2$ = 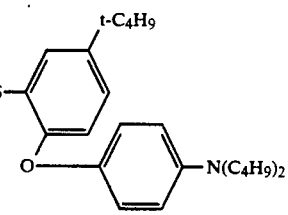
PP 8: $R_1$ = 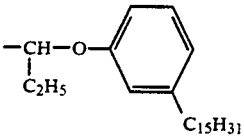 ; $R_2$ = 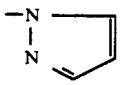

-continued
PP 9:
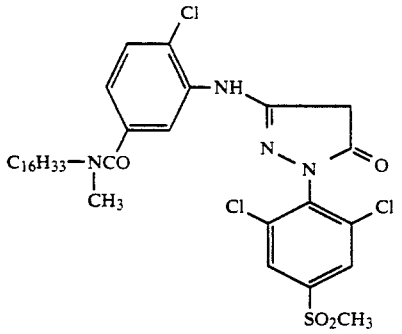
PP 10:
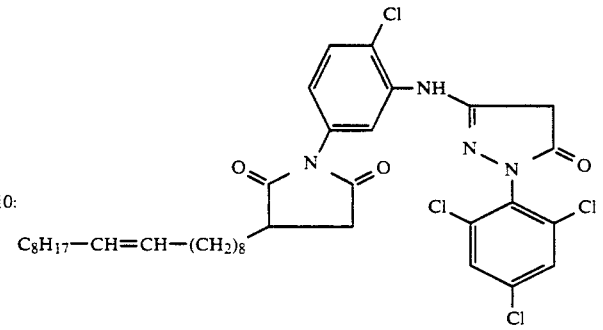
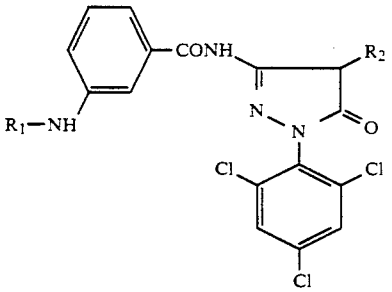
PP 11: $R_1$ = 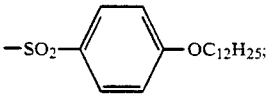 $R_2$ = H
PP 12: $R_1$ = 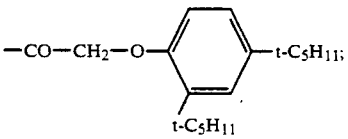 $R_2$ = H
PP 13: $R_1$ = 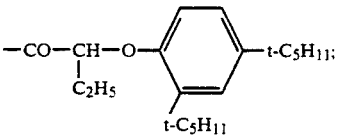 $R_2$ = H
PP 14: $R_1$ = 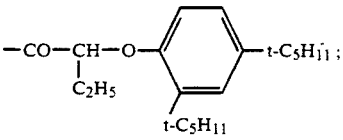 $R_2$ = 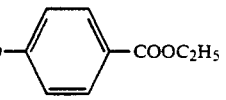

-continued
PP 15: $C_{17}H_{35}CONH$
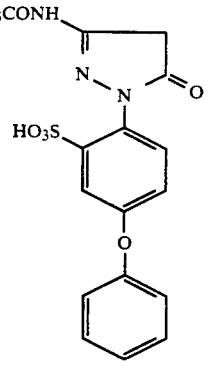
PP 16: $C_{15}H_{31}$
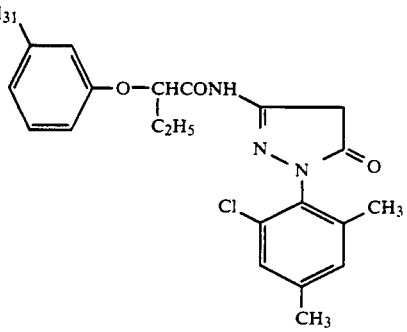
PP 17: $t\text{-}C_4H_9CONH$
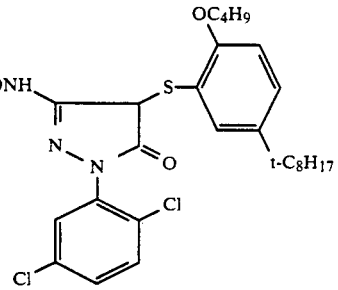
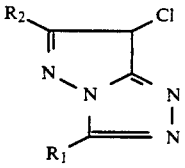
PP 18: $R_1 = -(CH_2)_3-$
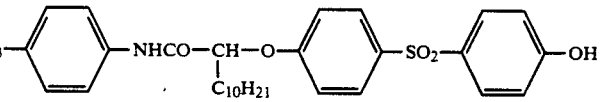
$R_2 = -CH_3$
PP 19: $R_1 = -(CH_2)_3-$
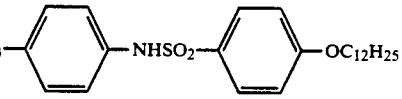
$R_2 = -CH_3$
PP 20: $R_1 =$
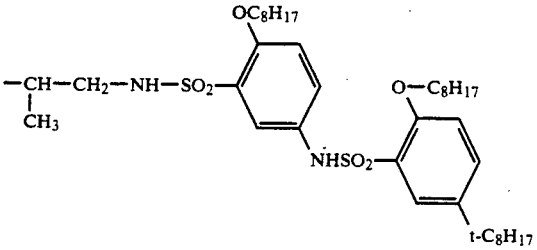
$R_2 = -t\text{-}C_4H_9$ -continued PP 21: $R_1$ = 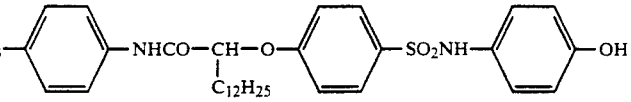 $R_2 = -CH_3$ PP 22: 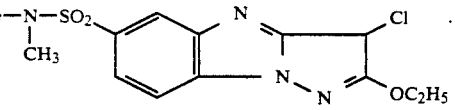

Colour couplers for producing the yellow partial colour image are generally couplers with an open-chain ketomethylene grouping, in particular couplers of the α-aclacetamide type; suitable examples thereof include α-benzoylacetanilide couplers and α-pivaloylacetanilide couplers corresponding to the formulae:

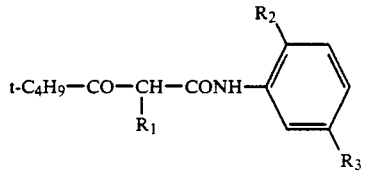

GB 1: $R_1$ = 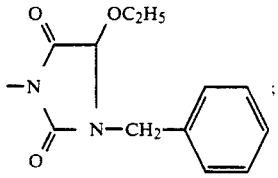 ; $R_2$ = Cl;

$R_3$ = 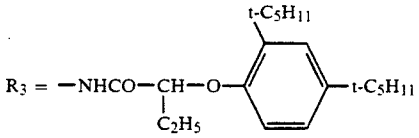

GB 2: $R_1$ = 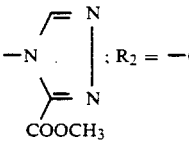 ; $R_2 = -OC_{16}H_{33}$; $R_3 = -SO_2NHCH_3$

GB 3: $R_1$ = 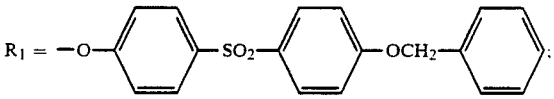 ; $R_2$ = Cl $R_3 = -NHSO_2-C_{16}H_{33}$

GB 4: $R_1$ = 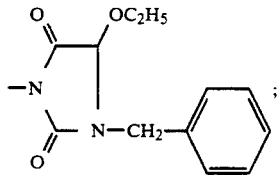 ; $R_2$ = Cl; $R_3 = -COOC_{12}H_{25}$

GB 5: $R_1$ = 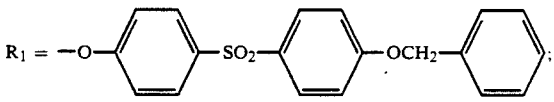 ; $R_2$ = Cl $R_3$ = 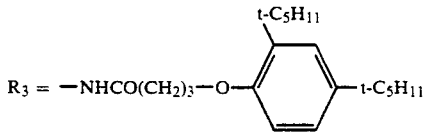

-continued
GB 6: $R_1$ = 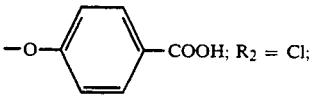 ; $R_2$ = Cl;
$R_3$ = 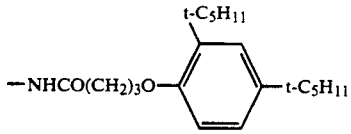
GB 7: $R_1$ = 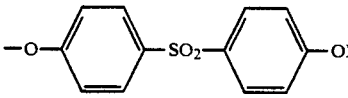 ; $R_2$ = Cl;
$R_3 = -NHSO_2C_{16}H_{33}$
GB 8: $R_1$ = 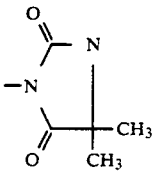 ; $R_2$ = Cl;
$R_3$ = 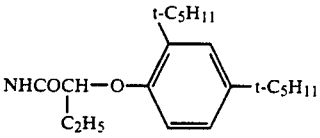
GB 9: $R_1$ = 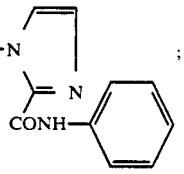 ; $R_2 = OC_{16}H_{33}$;
$R_3 = -SO_2NHCOC_2H_5$
GB 10: $R_1$ = 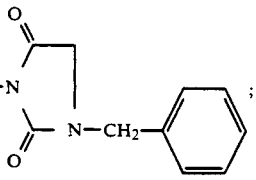 ; $R_2$ = Cl;
$R_3$ = 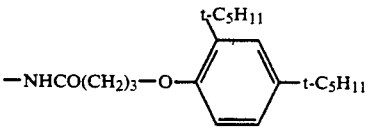
GB 11: $R_1$ = 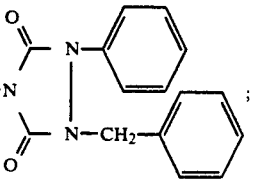 ; $R_2$ = Cl;
$R_3$ = 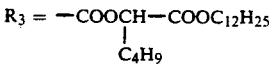

-continued
GB 12: $R_1$ = 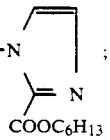 ; $R_2$ = Cl:
$R_3$ = 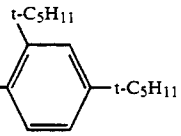
GB 13: $R_1$ = 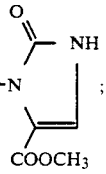 ; $R_2$ = $-OC_{16}H_{33}$; $R_3$ = $-SO_2NHCH_3$
GB 14: $R_1$ = 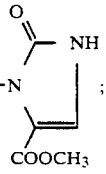 ; $R_2$ = Cl
$R_3$ = 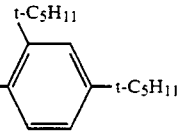
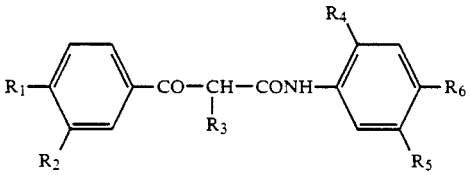
GB 15: $R_1$, $R_3$, $R_5$, $R_6$ = H: $R_4$ = $-OCH_3$;
$R_2$ = 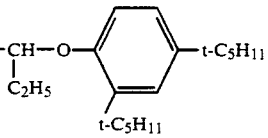
GB 16: $R_2$, $R_6$ = H; $R_1$ = $-OC_{16}H_{33}$; $R_4$, $R_5$ = $-OCH_3$;
$R_3$ = 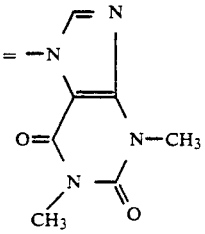
GB 17: $R_2$, $R_6$ = H; $R_1$ = $-OCH_3$, $R_4$ = Cl; $R_5$ = $-COOC_{12}H_{25}$;

-continued

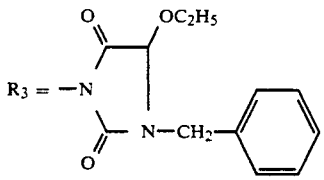

GB 18: $R_2$ = H; $R_1$ = $-OC_{16}H_{33}$; $R_4$ = Cl; $R_5$, $R_6$ = $-OCH_3$;

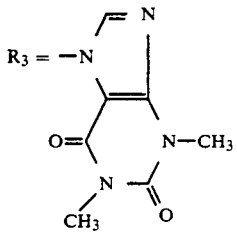

GB 19: $R_2$, $R_5$ = H; $R_1$ = $-OC_{16}H_{33}$; $R_4$ = $-OCH_3$;

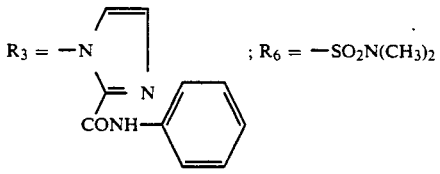

GB 20: $R_2$, $R_6$ = H; $R_1$, $R_4$ = $-OCH_3$;

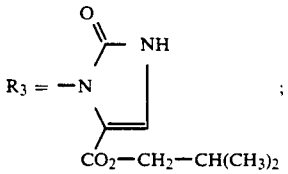

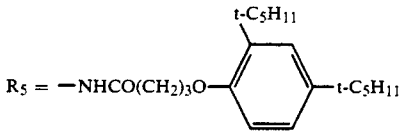

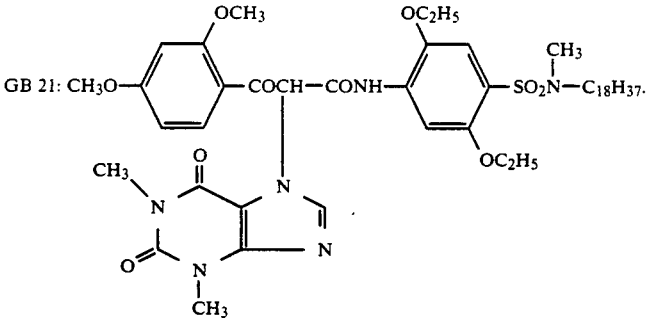

The colour couplers can be 4-equivalent couplers but also 2-equivalent couplers. The latter are derived from the 4-equivalent couplers in that they contain, in the coupling position, a substituent which is split off during coupling. The 2-equivalent couplers include the colourless ones as well as those having an intensive inherent colour which disappears during colour coupling or is replaced by the colour of the image dye produced (mask coupler), and the white couplers which produce substantially colourless products when reacted with colour developer oxidation products. The 2-equivalent couplers also include those couplers which contain, in the coupling position, a radical which can be split off, is liberated during the reaction with colour developer oxidation products and, in the process, a given desired photographic effect is opened up, for example as development inhibitor or accelerator, either directly or after one or more further groups have been split from the initially split off radical (for example DE-A-27 03-145, DE-A-28 55 697, DE-A-31 05 026, DE-A-33 19 428). Examples of such 2-equivalent couplers include the known DIR couplers as well as DAR and FAR couplers.
Examples of white couplers are:
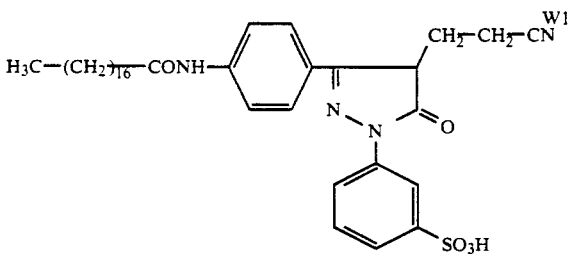
W1
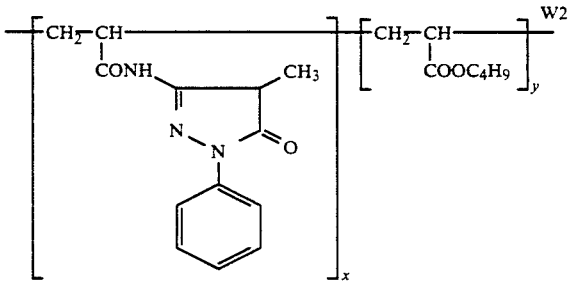
W2
-continued
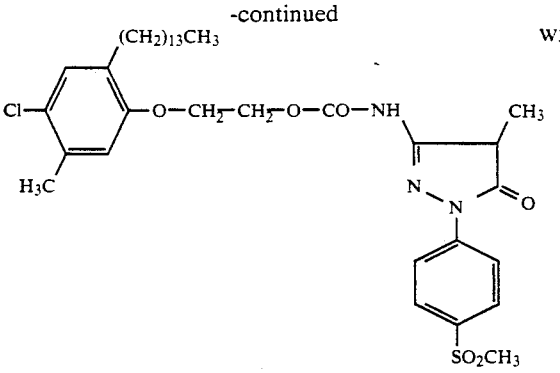
W3
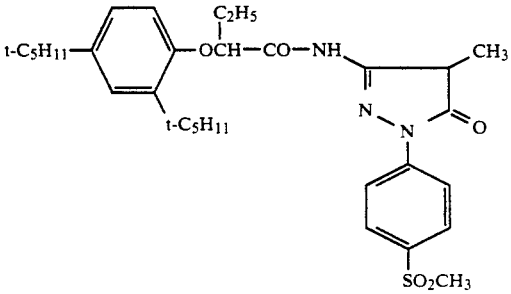
W4
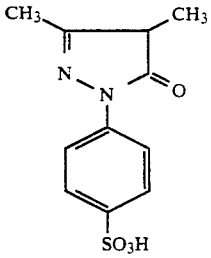
W5
Examples of mask couplers are:
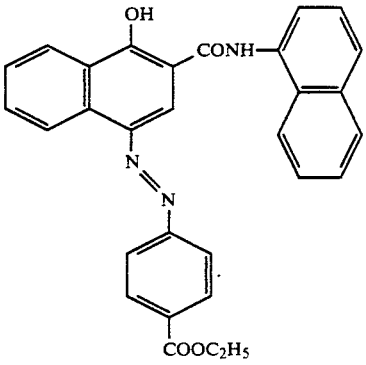
M1

-continued
M2
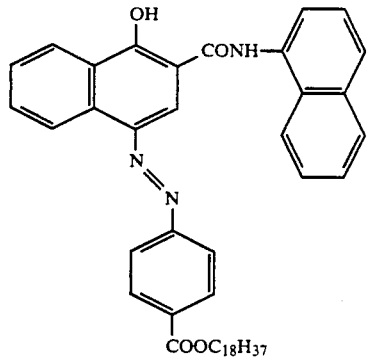
M3
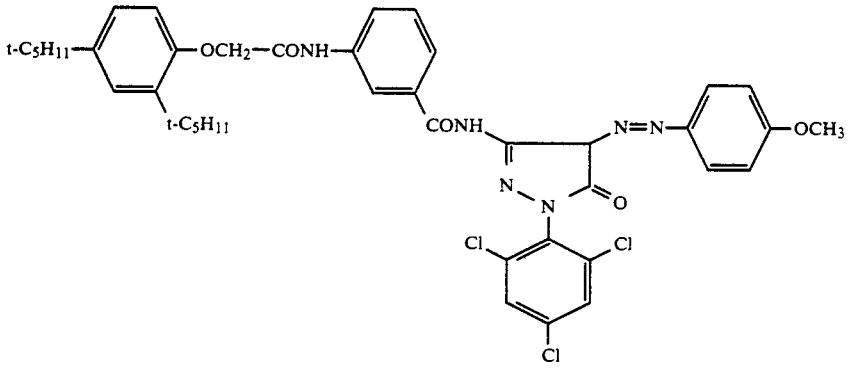
M4
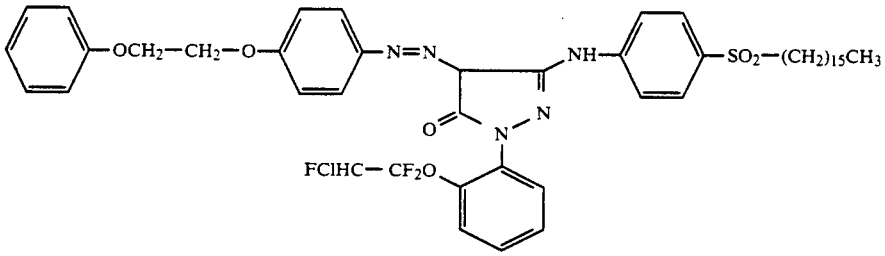
M5
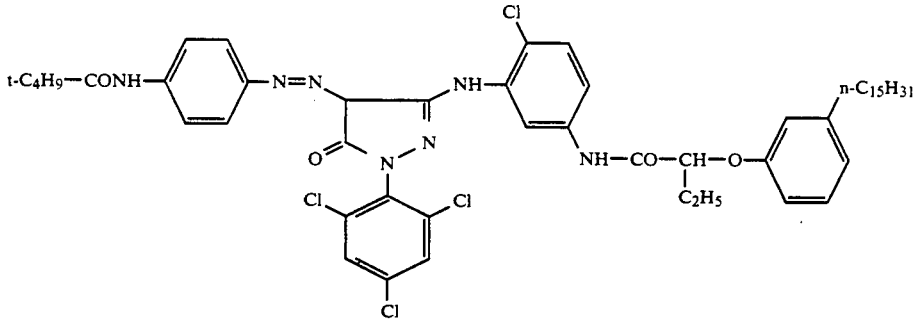
M6
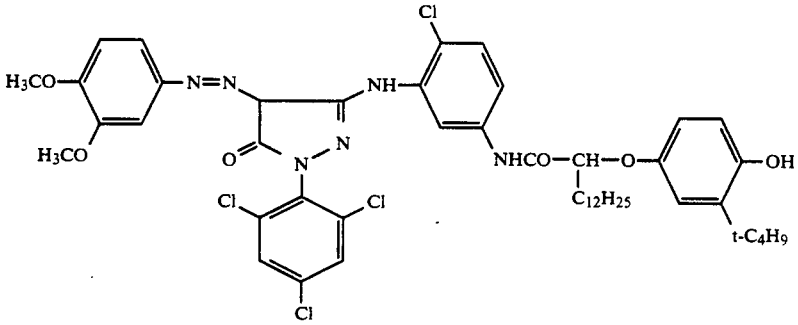

-continued
M7
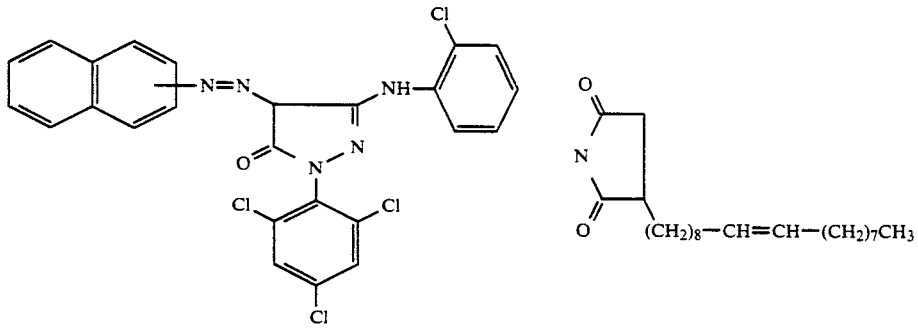
M8
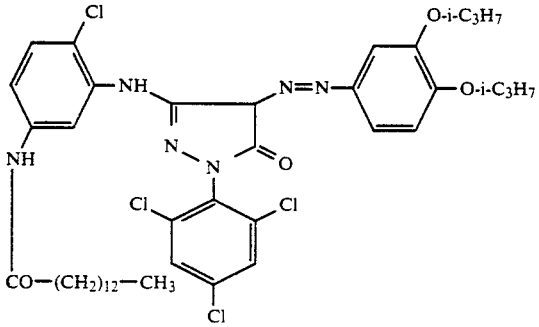
M9
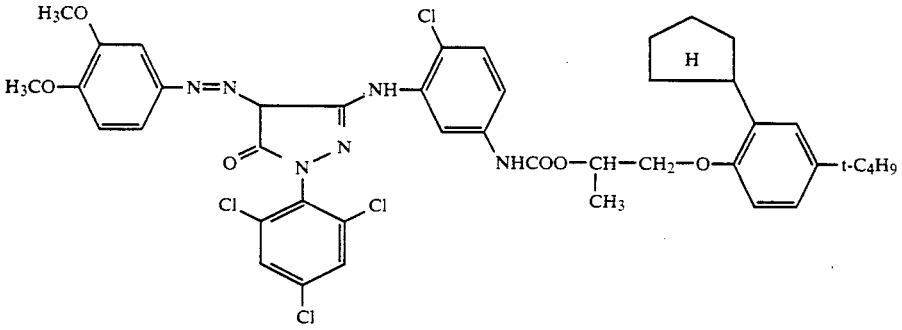
M10
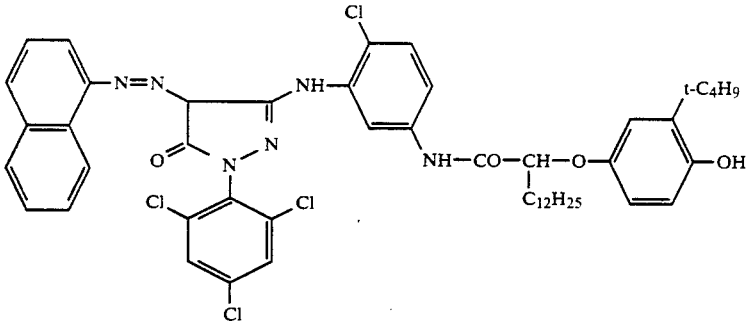
M11
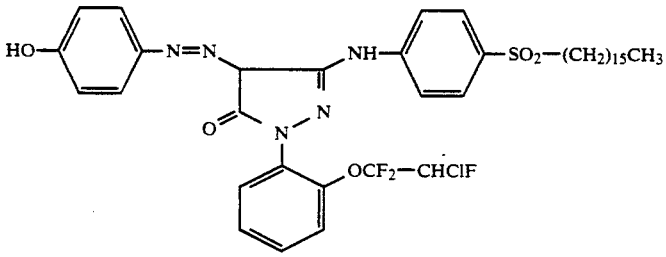

-continued
M12
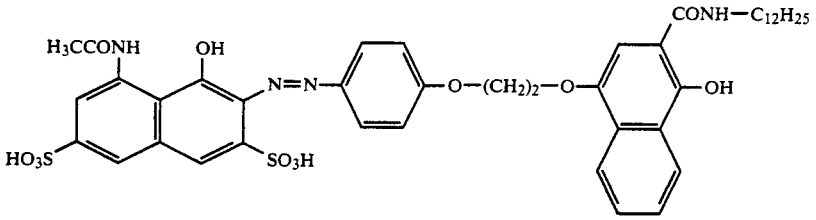
M13
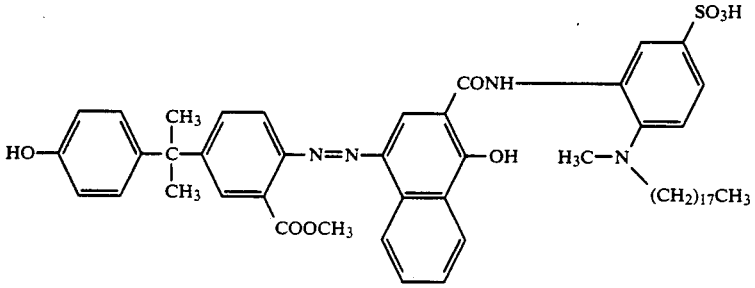
M14
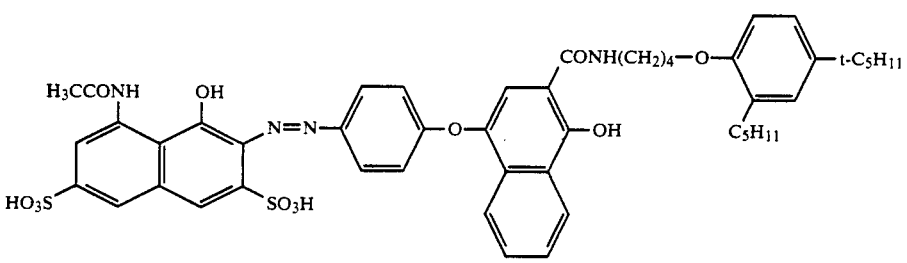
M15
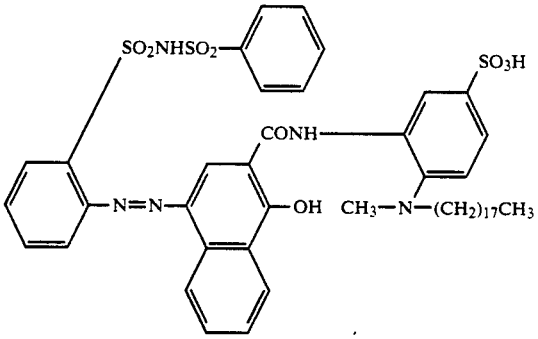
M16
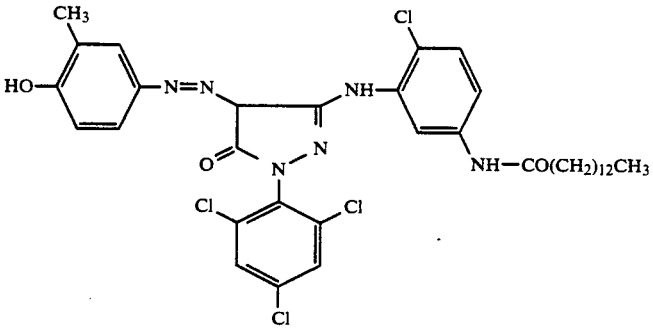

-continued

M17

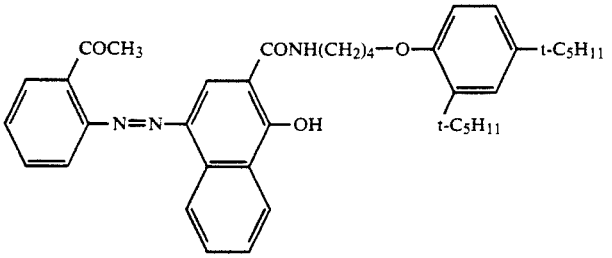

DIR couplers which liberate development inhibitors of the azole type, for example triazoles and benzotriazoles, are described in DE-A-24 14 006, 26 10 546, 26 59 417, 27 54 281, 27 26 180, 36 26 219, 36 30 564, 36 36 824, 36 44 416 and 28 42 -63. Further advantages for colour reproduction, i.e. colour separation and colour purity, and for the reproduction of details, i.e. definition and graininess, can be achieved with those DIR couplers which split off, for example, the development inhibitor not as a direct result of coupling with an oxidised color developer, but only after a further secondary reaction which is achieved, for example, using a time control group. Examples of them are described in DE-A-28 55 697, 32 99 671, 38 18 231, 35 18 797, in EP-A-157 146 and 204 175, U.S. Pat. Nos. 4,146,396 and 4,438,393 and in GS-B-2 072 363.

DIR couplers which liberate a development inhibitor which is decomposed in the developer bath to form photographically substantially ineffective products are described, for example, in DE-A-32 09 486 and in EP-A-167 168 and 219 713. Disturbance-free development and constancy of processing are achieved by this measure.

When using DIR couplers, in particular those which split off a readily diffusible development inhibitor, improvements in colour reproduction, for example differentiated colour reproduction, can be achieved by suitable measures during optical sensitization, as described, for example, in EP-A-115 304, 167 173, GB-A-2 165 058, DE-A-37 00 419 and U.S. Pat. No. 4,707,436.

The DIR couplers can be added to a wide variety of layers in a multi-layered photographic material, for example even light-insensitive or intermediate layers. However, they are preferably added to the light-sensitive silver halide emulsion layers, the characteristic properties of the silver halide emulsion, for example the iodide content thereof, the structure of the silver halide grains or the grain size distribution thereof, affecting the resultant photographic properties. The effect of the liberated inhibitors can be limited, for example, by the incorporation of an inhibitor collecting layer according to DE-A-24 31 223. Owing to the reactivity or stability, it may be advantageous to introduce a DIR coupler, which, during coupling, forms, in the respective layer in which it is introduced, a colour deviating from the colour to be produced in this layer.

In particular, DAR and FAR couplers which split off a development accelerator or a fogging agent can be used to increase the sensitivity, contrast and maximum density. Compounds of this type are described, for example, in DE-A-25 34 466, 32 09 110, 33 33 355, 34 10 616, 34 29 545, 34 41 823, in EP-A-89 834, 110 511, 118 087, 147 765 and in U.S. Pat. Nos. 4,618,572 and 4,656,123.

Reference is made to EP-A-193 389 as an example of the use of BAR couplers (bleach accelerator releasing coupler).

It may be advantageous to modify the effect of a photographically effective group which is split from a coupler in that this group, after being liberated, enters an intermolecular reaction with another group according to DE-A-35 06 805.

Examples of DIR couplers are:

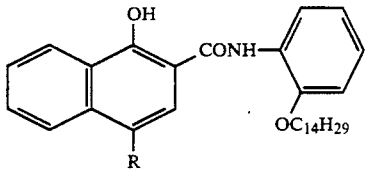

DIR 1

R =

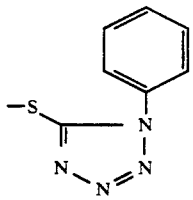

R =

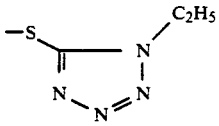

DIR 2

DIR 3

R =

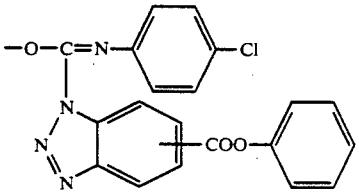

-continued
DIR 4
R =
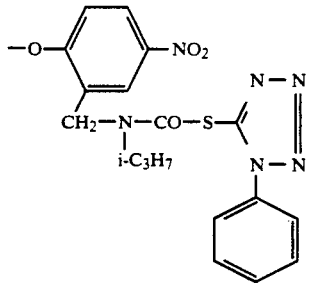
DIR 5
R =
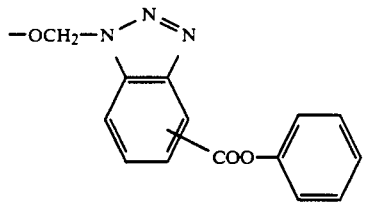
DIR 6
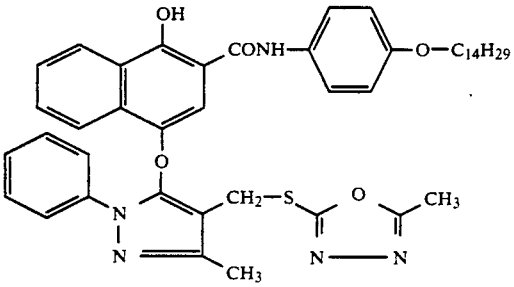
DIR 7
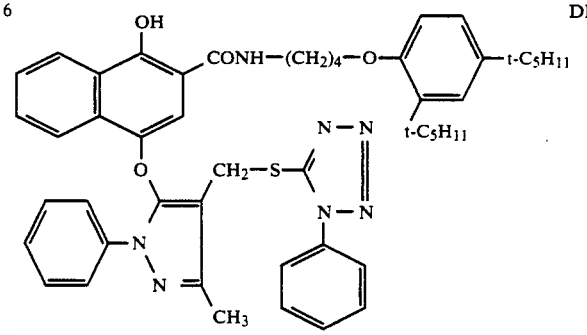
DIR 8
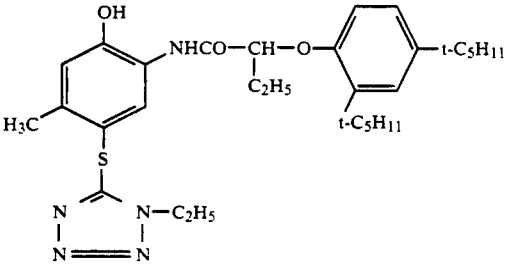
DIR 9
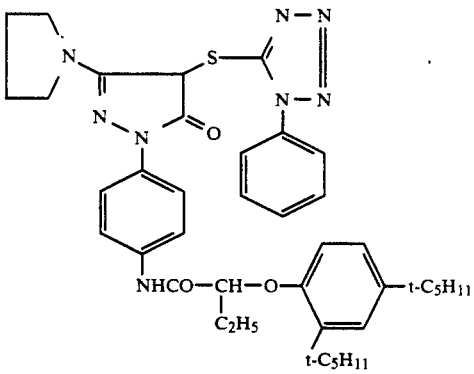
DIR 10
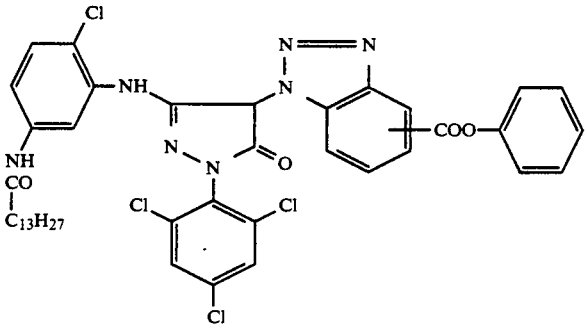

-continued
DIR 11
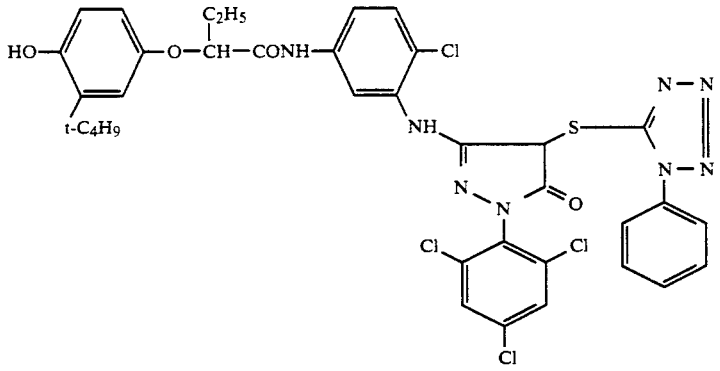
DIR 12
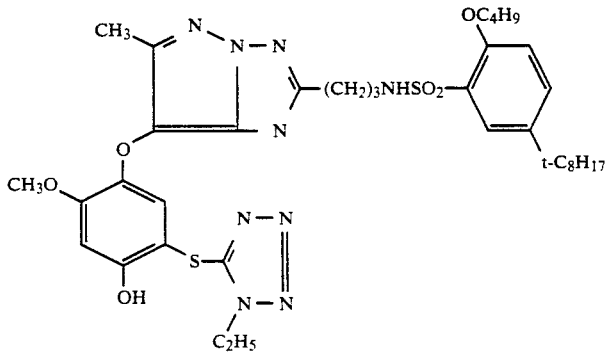
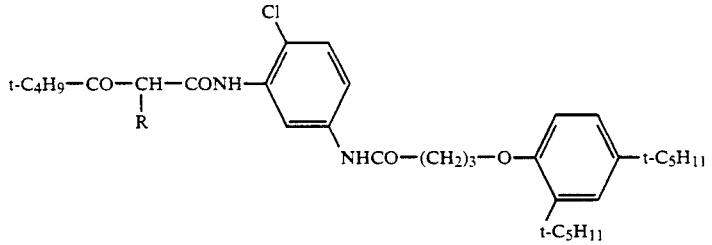
DIR 13
R =
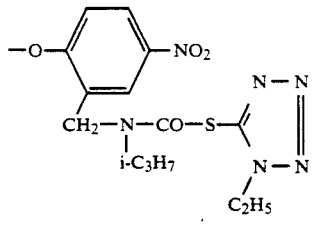
DIR 14
R =
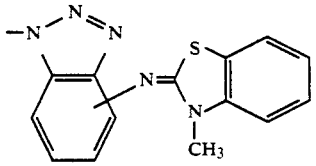
DIR 15
R =
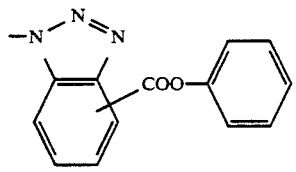
DIR 16
R =
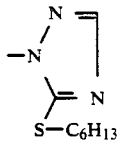
DIR 17
R =
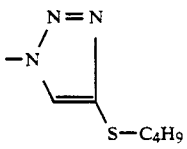

-continued
DIR 18
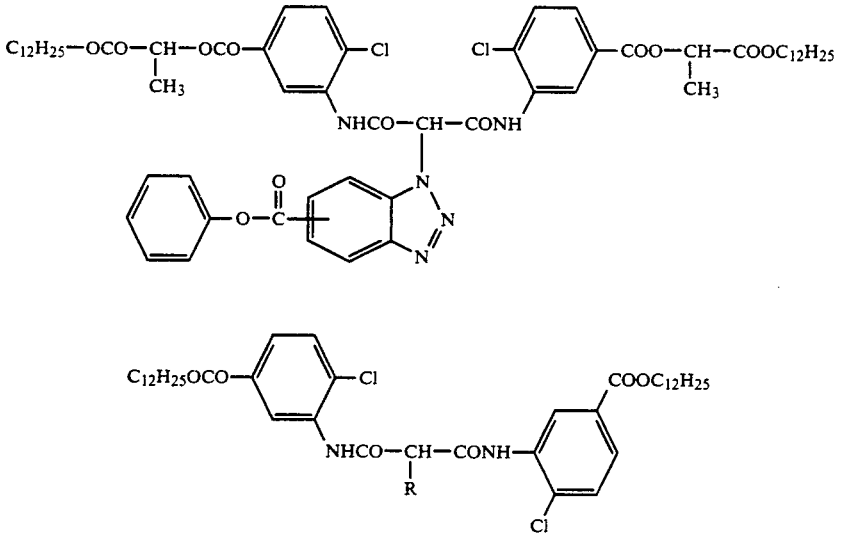
DIR 19
R =
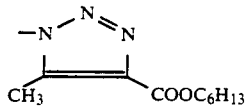
DIR 20
R =
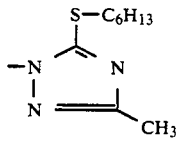
DIR 21
R =
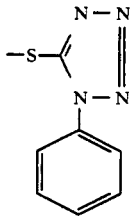
DIR 22
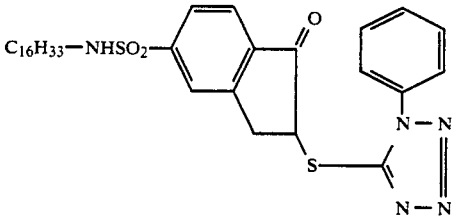
DIR 23
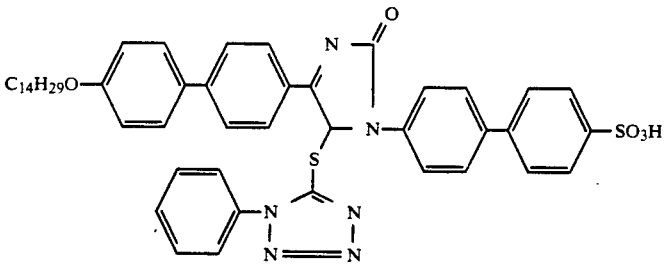
DIR 24
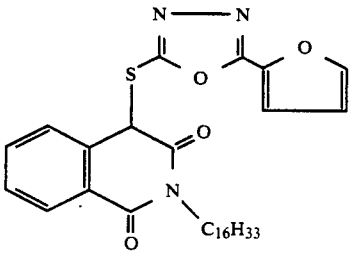
Examples of DAR couplers:

-continued

DAR 1

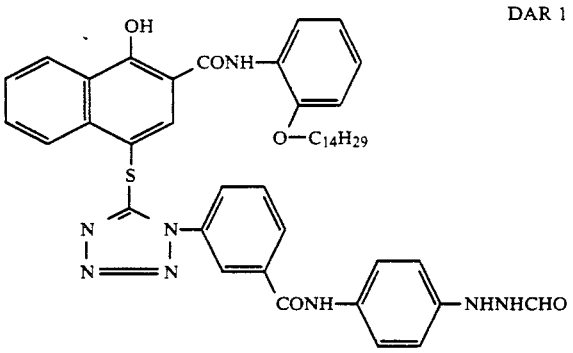

DAR 2

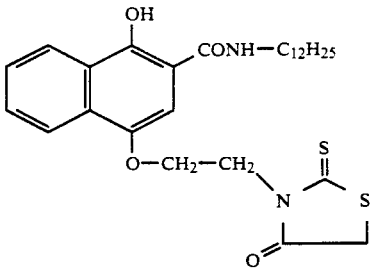

DAR 3

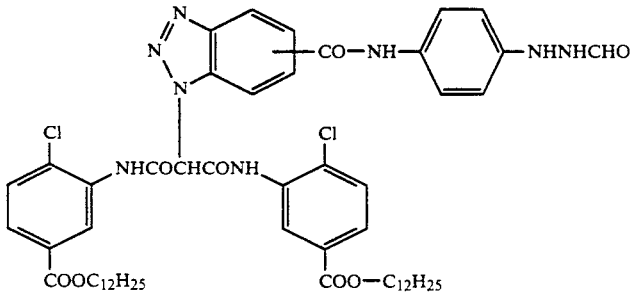

As the action of the radical liberated during coupling is mainly desired in the DIR, DAR and FAR couplers and the colour-forming properties of these couplers are less important, DIR, DAR and FAR couplers which yield substantially colourless products during coupling are also suitable (DE-A-15 47 640).

The radical which can be split off can also be a ballast radical so that coupling products which are diffusible or have at least weak or restricted mobility are obtained during the reaction with colour development oxidation products (U.S. Pat. No. 4,420,556).

The material can also contain compounds which are different from couplers and which can liberate, for example, a development inhibitor, a development accelerator, a bleach accelerator, a developer, a silver halide solvent, a fogging agent or an anti-fogging agent, for example so-called DIR hydroquinones and other compounds of the type described, for example, in U.S. Pat. Nos. 4,636,546, 4,345,024, 4,684,604 and in DE-A-31 45 640, 25 15 213, 24 47 079 and in EP-A-198 438. These compounds fulfil the same function as the DIR, DAR or FAR couplers, except that they do not form coupling products.

High molecular weight colour couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4,080,211. The high molecular weight colour couplers are generally produced by polymerisation of ethylenically unsaturated monomeric colour couplers. However, they can also be obtained by polyaddition or polycondensation.

The couplers or other compounds can be incorporated in silver halide emulsion layers by initially producing a solution, a dispersion or an emulsion of the respective compound and then adding it to the casting solution for the respective layer. The choice of a suitable solvent or dispersant depends on the respective solubility of the compound.

Methods of introducing compounds which are substantially insoluble in water by grinding processes are described, for example, in DE-A-26 09 741 and DE-A-26 09 742.

Hydrophobic compounds can also be introduced into the casting solution by using high-boiling-point solvents, so-called oil forming agents. Suitable methods are described, for example, in U.S. Pat. No. 2,322,027, U.S. Pat. No. 2,801,170, U.S. Pat. No. 2,801,171 and EP-A-0 043 037.

Oligomers or polymers, so-called polymeric oil-forming agents can be used instead of the high-boiling-point solvents.

The compounds can also be introduced into the casting solution in the form of charged latices. Reference is made, for example, to DE-A-25 41 230, DE-A-25 41 274, DE-A-28 35 856, EP-A-0 014 921, EP-A-0 069 671, EP-A-0 130 115, U.S. Pat. No. 4,291,113.

The diffusion-resistant incorporation of anionic water-soluble compounds (for example of dyes) can also be effected by means of cationic polymers, so-called mordant polymers.

Suitable oil-forming agents include, for example, phthalic acid alkylesters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil-forming agents include dibutylphthalate, dicyclohexylphthalate, di-2-ethylhexylphthalate, decylphthalate, triphenylphosphate, tricresylphosphate, 2-ethylhexyldiphenylphosphate, tricyclohexylphosphate, tri-2-ethylhexylphosphate, tridecylphosphate, tributoxyethylphosphate, trichlorpropylphosphate, di-2-ethylhexylphenylphosphate, 2-ethylhexylbenzoate, dodecylbenzoate, 2-ethylhexyl-p-hydroxybenzoate, diethyldodecanamide, N-tetradecylpyrrolidone, isostearylalcohol, 2,4-di-tert.-amylphenol, dioctylacetate, glyceroltributyrate, isostearyllactate, trioctylcitrate, N,N-dibutyl-2-butoxy-5-tert.-octylaniline, paraffin, dodecylbenzene and diisopropylnaphthalene.

Each of the differently sensitized light-sensitive layers can consist of a single layer or can also comprise two or more silver halide emulsion partial layers (DE-C-1 121 470). Red-sensitive silver halide emulsion layers are frequently arranged closer to the layer substrate than green-sensitive silver halide emulsion layers which, in turn, are located closer than blue-sensitive ones, a light-insensitive yellow filter layer generally being located between green-sensitive layers and blue-sensitive layers.

If the inherent sensitivity of the green-sensitive and red-sensitive layers is suitably low, other layer arrangements can be selected, omitting the yellow filter layer, in which, for example, the blue-sensitive, then the red-sensitive and finally the green-sensitive layers follow on the substrate.

The light-insensitive intermediate layers generally arranged between layers having different spectral sensitivity can contain agents which prevent undesirable diffusion of developer oxidation products from one light-sensitive layer into another light-sensitive layer having different spectral sensitization.

Suitable agents which are also called scavengers or EOP collectors are described in Research Disclosure 17 643 (Dec. 1978), chapter VII, 17 842/1979, pages 94–97 and 18.716/1979, page 650 as well as in EP-A-69 070, 98 072, 124 877, 125 522 and in U.S. Pat. No. 463 226.

Examples of particularly suitable compounds include:

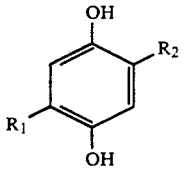

$R_1, R_2$ = -t-$C_8H_{17}$
-s-$C_{12}H_{25}$
-t-$C_6H_{13}$

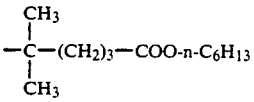

-s-$C_8H_{17}$
—$C_{15}H_{31}$

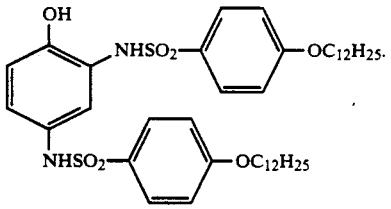

If several partial layers of equal spectral sensitization are present, they can differ with respect to their composition, in particular with regard to the type and quantity of silver halide grains. The partial layer with higher sensitivity is generally arranged further away from the substrate than the partial layer with lower sensitivity. Partial layers having equal spectral sensitization can be adjacent to one another or can be separated by other layers, for example by layers having different spectral sensitization. For example, all high-sensitivity and all low-sensitivity layers can be combined in each case to form a layer package (DE-A-19 58 709, DE-A-25 30 645, DE-A-26 22 922).

The photographic material can also contain UV-light absorbing compounds, white toners, spacers, filter dyes, formalin collectors, light-proofing agents, antioxidants, $D_{Min}$ dyes, additives for improving the dye, coupler and white stabilisation and for reducing the colour fogging, plasticisers (latices), biocides and others.

UV-light absorbing compounds should, on the one hand, protect the image dyes prior to bleaching with UV-rich daylight and, on the other hand, as filter dyes, absorb the UV-light in the daylight during exposure and thus improve the colour reproduction of a film. Compounds having different structures are usually used for both tasks. Examples include aryl-substituted benzotriazole compounds (U.S. Pat. No. 3,533,794), 4-thiazolidone compounds (U.S. Pat. Nos. 3,324,794 and 3,352,681), benzophenone compounds (JP-A-2784/71), cinnamic acid ester compounds (U.S. Pat. Nos. 3,705,805 and 3,707,375), butadiene compounds (U.S. Pat. No. 4,045,229) or benzoxazole compounds (U.S. Pat. No. 3,700,455).

Examples of particularly suitable compounds include:

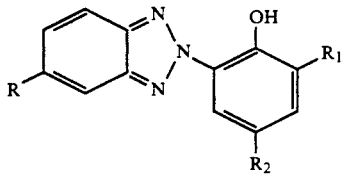

R, $R_1$ = H; $R_2$ = t-$C_4H_9$
R = H; $R_1$, $R_2$ = t-$C_4H_9$
R = H; $R_1$, $R_2$ = t-$C_5H_{11}$
R = H; $R_1$ = s-$C_4H_9$; $R_2$ = t-$C_4H_9$
R = Cl; $R_1$ = t-$C_4H_9$; $R_2$ = s-$C_4H_9$
R = Cl; $R_1$, $R_2$ = t-$C_4H_9$
R = Cl; $R_1$ = t-$C_4H_9$; $R_2$ = —$CH_2$—$CH_2$—$COOC_8H_{17}$
R = H; R = i-$C_{12}H_{25}$; $R_2$ = $CH_3$
R, $R_1$, $R_2$ = t-$C_4H_9$

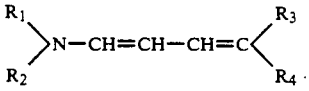

$R_1$, $R_2$ = n-$C_6H_{13}$; $R_3$, $R_4$ = CN $R_1$, $R_2$ = $C_2H_5$; $R_3$ = —$SO_2$— 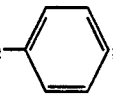 ; $R_4$ = $COOC_8H_{17}$ $R_1$, R = $C_2H_5$; $R_3$ = —$SO_2$— 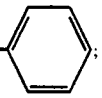 ; $R_4$ = $COOC_{12}H_{25}$ $R_1$, $R_2$ = $CH_2$=CH—$CH_2$; $R_3$, $R_4$ = CN

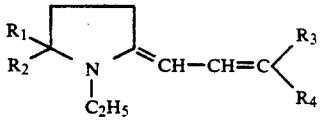

$R_1$, $R_2$ = H; $R_3$ = CN; $R_4$ = CO—$NHC_{12}H_{25}$
$R_1$, $R_2$ = $CH_3$; $R_3$ = CN; $R_4$ = CO—$NHC_{12}H_{25}$

-continued

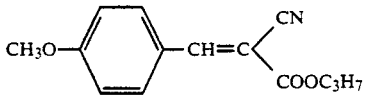

Ultraviolet-absorbing couplers (such as cyan couplers of the α-naphthol type) and ultraviolet-absorbing polymers can also be used. These ultraviolet absorbents can be fixed in a special layer by mordant action.

Filter dyes suitable for visible light include oxonol dyes, hemioxonol dyes, styryl dyes, merocyanine dyes, cyanine dyes and azo dyes. From among these dyes, it is particularly advantageous to use oxonol dyes, hemioxonol dyes and merocyanine dyes.

Suitable white toners are described, for example, in Research Disclosure 17 643 (December 1978), chapter V, in U.S. Pat. Nos. 2,632,701, 3,269,840 and in GB-A-852 075 and 1 319 763.

Certain binder layers, in particular the layer furthest removed from the substrate, but occasionally also intermediate layers, particularly if they are the layer furthest removed from the substrate during production, can contain photographically inert particles of an inorganic or organic nature, for example as matting agents or as spacers (DE-A-33 31 542, DE-A-34 24 893, Research Disclosure 17 643, (Dec. 1978), chapter XVI).

The average particle diameter of the spacers lies, in particular, in the range of 0.2 to 10 μm. The spacers are water-insoluble and can be alkali-insoluble or alkali-soluble, the alkali-soluble spacers generally being removed from the photographic layer in the alkaline development bath. Examples of suitable polymers include polymethylmethacrylate, copolymers of acrylic acid and methylmethacrylate as well as hydroxypropylmethylcellulosehexahydrophthalate.

Suitable formaline collectors include, for example,

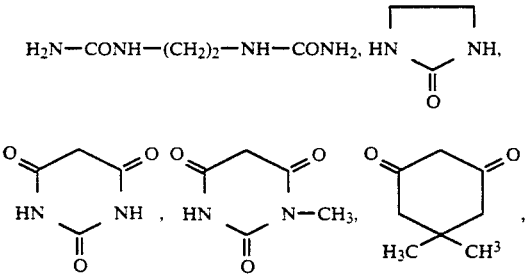

-continued

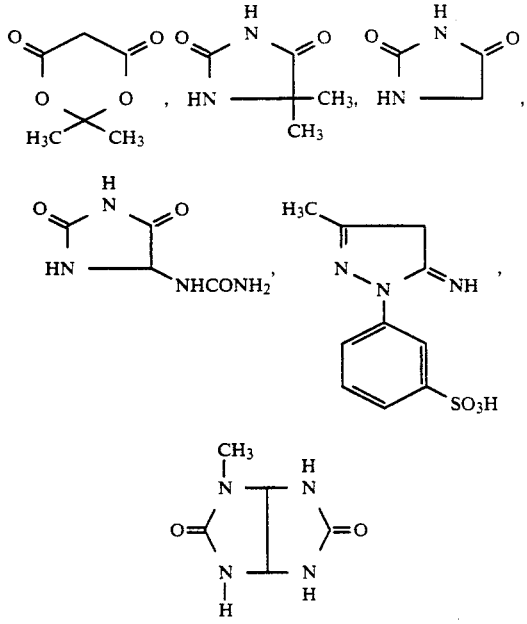

Additives for improving the dye, coupler and white stability as well as for reducing the colour fog (Research Disclosure 17 643/1978, chapter VII) can belong to the following categories of chemical substances: hydroquinones, 6-hydroxychromanes, 5-hydroxycumaranes, spirochromanes, spiroindanes, p-alkoxyphenols, sterically hindered phenols, gallic acid derivatives, methylenedioxybenzenes, aminophenols, sterically hindered amines, derivatives containing esterified or etherified phenolic hydroxyl groups, metal complexes.

Compounds having both a sterically hindered amine partial structure and a sterically hindered phenol partial structure in a molecule (U.S. Pat. No. 4,268,593) are particularly effective in preventing impairment (deterioration and decomposition) of yellow colour forming agents due to the evolution of heat, moisture and light. To prevent the impairment (deterioration and decomposition) of magenta colour forming agents, in particular their impairment (deterioration and decomposition) due to the action of light, spiroindanes (JP-A-159 644/81) and chromanes which are substituted by hydroquinone diether or monoether (JP-A-89 835/80) are particularly effective.

Examples of particularly suitable compounds include:

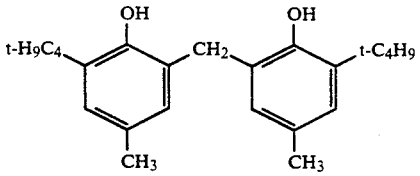

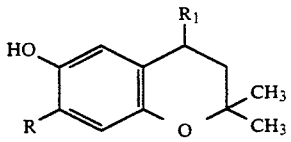

R = t-$C_8H_{17}$; $R_1$ = $CH_3$
R = n-$C_8H_{17}$; $R_1$ = i-$C_3H_7$

-continued

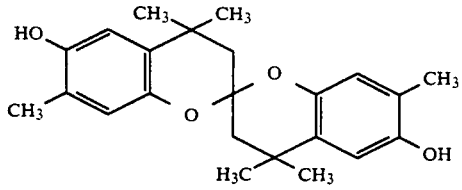

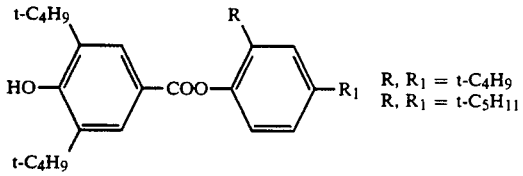

R, $R_1$ = t-$C_4H_9$
R, $R_1$ = t-$C_5H_{11}$

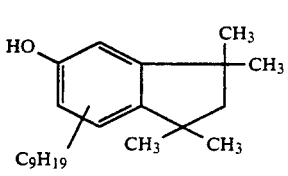

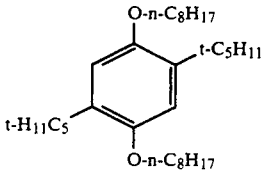

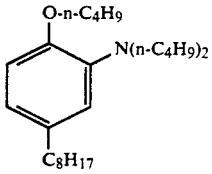

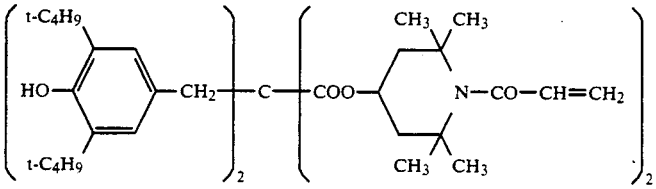

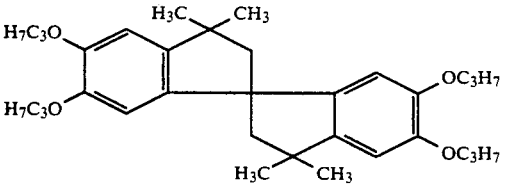

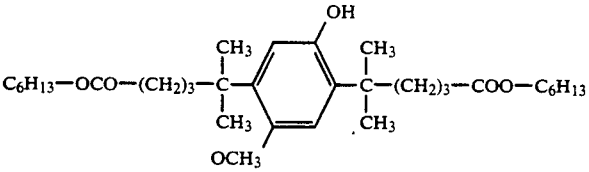

and the compounds mentioned as EOP-collectors.

The layers of the photographic material can be hardened with the conventional hardeners. Suitable hardeners include, for example, formaldehyde, glutaraldehyde and similar aldehyde compounds, diacetyl, cyclopentadione and similiar ketone compounds, bis-(2-chloroethylurea), 2-hydroxy-4,6-dichloro-1,3,5-triazine and other compounds which contain reactive halogen (U.S. Pat. No. 3,288,775, U.S. Pat. No. 2,732,303, GB-A-974 723 and GB-A-1 167 207), divinylsulphone compounds, 5-acetyl-1,3-di-acryloylhexahydro-1,3,5-triazine and other compounds which contain a reactive olefin bond (U.S. Pat. No. 3,635,718, U.S. Pat. No. 3,232,763 and GB-A-994 869); N-hydroxymethylphthalimide and other N-methylol compounds (U.S. Pat. No. 2,732,316 and U.S. Pat. No. 2,586,168); isocyanates (U.S. Pat. No. 3,103,437); aziridine compounds (U.S. Pat. No. 3,017,280 and U.S. Pat. No. 2,983,611); acid derivatives (U.S. Pat. No. 2,725,294 and U.S. Pat. No 2,752,295); compounds of the carbodiimide type (U.S. Pat. No. 3,100,704); carbamoylpyridinium salts (DE-A-22 25 230 and DE-A-24 39 551); carbamoyloxypyridinium compounds (DE-A-24 08 814); compounds with a phosphorus halogen bond (JP-A-113 929/83); N-carbonyloximide compounds (JP-A-43353/81); N-sulphonyloximido compounds (U.S. Pat. No. 4,111,926), dihydroquinoline compounds (U.S. Pat. No. 4,013,468), 2-sulphonyloxypyridinium salts (JP-A-110 762/81), formamidinium salts (EP-A-0 162 308), compounds containing two or more N-acyloximino groups (U.S. Pat. No. 4,052,373), epoxy compounds (U.S. Pat. No. 3,091,537), compounds of the isoxazole type (U.S. Pat. No. 3,321,313 and U.S. Pat No. 3,543,292); halogen carboxyaldehydes such as mucochloric acid; dioxan derivatives such as dihydroxydioxan and dichlorodioxan; and inorganic hardeners such as chrome alum and zirconium sulphate.

Hardening can be carried out in a known manner by adding the hardener to the casting solution for the layer to be hardened or by covering the layer to be hardened with a layer containing a diffusible hardener.

The above-mentioned categories include slowly acting and rapidly acting hardeners as well as so-called instant hardeners, which are particular advantageous. The term instant hardeners denotes compounds which crosslink suitable binders such that, immediately after casting, at the latest after 24 hours and preferably at the latest after 8 hours, hardening is sufficiently far completed for no further change in sensitometry and swelling of the layer assembly to occur due to the crosslinking reaction. The term swelling denotes the difference between wet layer thickness and dry layer thickness during the aqueous processing of the film (Photogr. Sci., Eng. 8 (1964), 275; Photogr. Sci. Eng. (1972), 449).

These hardeners which react very rapidly with gelatins are, for example, carbamoylpyridinium salts capable of reacting with free carboxyl groups of the gelatin so that the latter react with free amino groups of the gelatin to form peptide bonds and crosslink the gelatin .

Suitable examples of instant hardeners include, for example, compounds corresponding to the general formulae:

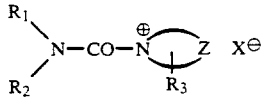

(a)

wherein $R_1$ represents alkyl, aryl or aralkyl, $R_2$ has the same meaning as $R_1$ or represents alkylene, arylene, aralkylene or alkaralkylene, the second bond being linked to a group corresponding to the formula:

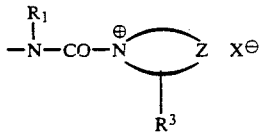

or, $R_1$ and $R_2$ together represent the atoms required for completing an optionally substituted heterocyclic ring, for example a piperidine, piperazine or morpholine ring, wherein the ring can be substituted, for example, by $C_1$–$C_3$-alkyl or halogen, $R_3$ represents hydrogen, alkyl, aryl, alkoxy, $—NR_4—COR_5$, $—(CH_2)_m—NR_8R_9$, $—(CH_2)_n—CONR_{13}R_{14}$ or $$—(CH_2)_p—\underset{\underset{R_{15}}{|}}{CH}—Y—R_{16}$$

or a bridge member or a direct bond onto a polymer chain, wherein $R_4$, $R_6$, $R_7$, $R_9$, $R_{14}$, $R_{15}$, $R_{17}$, $R_{18}$ and $R_{19}$ represent hydrogen or $C_1$–$C_4$-alkyl, $R_5$ represents hydrogen, $C_1$–$C_4$-alkyl or $NR_6R_7$, $R_8$ represents $COR_{10}$, $R_{10}$ represents $NR_{11}R_{12}$, $R_{11}$ represents $C_1$–$C_4$-alkyl or aryl, in particular phenyl, $R_{12}$ represents hydrogen, $C_1$–$C_4$-alkyl or aryl, in particular phenyl, $R_{13}$ represents hydrogen, $C_1$–$C_4$-alkyl or aryl, in particular phenyl, $R_{16}$ represents hydrogen, $C_1$–$C_4$-alkyl, $COR_{18}$ or $CONHR_{19}$, m is a number from 1 to 3, n is a number from 0 to 3, p is a number from 2 to 3,and Y is O or $NR_{17}$, or p0 $R_{13}$ and $R_{14}$ together represent the atoms required for completing an optionally substituted heterocyclic ring, for example a piperidine, piperazine or morpholine ring, wherein the ring can be substituted, for example, by $C_1$–$C_3$-alkyl or halogen, Z represents the C-atoms required for completing a 5- or 6-membered aromatic heterocyclic ring, optionally with anellated benzene ring, and $X^{\ominus}$ represents an anion which is dispensed with an anionic group if already linked to the other molecule

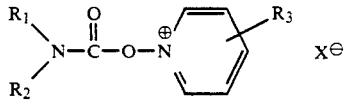

(b)

wherein $R_1$, $R_2$, $R_3$ and $X^{\ominus}$ have the meaning given for formula (a).

There exist diffusible hardeners which have a similar hardening effect on all layers within a layer assembly. However, there are also non-diffusing, low molecular weight and high molecular weight hardeners which have a reduced layer effect. Individual layers, for example the protective layer, can be crosslinked particularly markedly with them. This is important if the silver halide layer is slightly hardened owing to the increase in the silver body and the mechanical properties have to be improved with the protective layer (EP-A 0 114 699).

Colour photographic negative materials are usually processed by development, bleaching, fixing and washing or by developing, bleaching, fixing and stabilising without subsequent washing, wherein bleaching and fixing can be combined in a single processing stage. All developer compounds capable of reacting, in the form of their oxidation product, with colour couplers, to form azomethine or indophenol dyes can be used as colour developer compound. Suitable colour developer compounds include aromatic compounds containing at least one primary amino group of the p-phenylenediamine type, for example N,N-dialkyl-p-phenylenediamines such as N,N-diethyl-p-phenylenediamine, 1-(N-ethyl-N-methanesulphonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Other useful colour developers are described, for example, in J. Amer. Chem. Soc. 73, 3106 (1951) and G. Haist, Modern Photographic Processing, 1979, John Wiley and Sons, New York, page 545 et seq.

An acidic stop bath or washing can follow colour development.

The material is usually bleached directly after colour development and fixed. Suitable bleaching agents include, for example, Fe(III)-salts and Fe(III)-complex salts such as ferricyanides, dichromates, water-soluble cobalt complexes. Iron-(III)-complexes of aminopolycarboxylic acids, in particular, for example, of ethylenediamine tetraacetic acid, propylenediamine tetraacetic acid, diethylenetriamine pentaacetic acid, nitrilotriacetic acid, iminodiacetic acid, N-hydroxyethylethylenediamine triacetic acid, alkyliminodicarboxylic acids and of corresponding phosphonic acids are particularly preferred. Persulphates and peroxides, for example hydrogen peroxide, are suitable as bleaching agents.

The bleach fixing bath or fixing bath is usually followed by washing, which is carried out as counter-current washing or consists of several tanks with their own water supply.

Desirable results can be obtained when subsequently using a final bath containing no formaldehyde or a small amount of formaldehyde.

However, washing can also be completely replaced by a stabilising bath, which is usually guided in a counter-current. When formaldehyde is added, this stabilising bath also assumes the role of a final bath.

With colour reversal materials, development is initially carried out using a black/white developer of which the oxidation product is incapable of reacting with the colour couplers. Diffused double exposure and then development with a colour developer, bleaching and fixing follow.

EXAMPLE 1

A solution of 110 g of inert hide gelatin in 5.5 1 of water is adjusted to pH 3.0 at 40° C. using nitric acid. A solution of 17 g of silver nitrate in 100 ml of water and a solution of 13 g of potassium bromide in 100 ml of water are added to this solution within 25 seconds with vigorous stirring by the double jet process, the pAg being maintained at 6.0.

The emulsion is then adjusted to pH 6.0 using sodium hydroxide solution, is heated to 75° C. and is stirred for 120 minutes. A solution of 153 g of silver nitrate in 900 ml of water and a solution of 117 g of potassium bromide in 900 ml of water are then added at a constant rate over 30 minutes by the double jet process, the pAg being maintained at 6.0. The emulsion is cooled to 40° C. and the pAg is adjusted to 7.5 using potassium bromide.

Ultrafiltration is used to concentrate the emulsion and to remove the soluble salts. After addition of 60 g inert hide gelatin, the emulsion is adjusted to a silver content of 50 g (calculated as silver nitrate) per kilogram. 3.4 kg of emulsion are obtained.

The grain size of the silver bromide emulsion is determined using an electrolytic grain size analyzer and is 0.50 μm with a coefficient of variation of 0.16, the grain size distribution being shown in FIG. 5. More than 95% of the grain shape are of the type corresponding to FIG. 1.

EXAMPLE 2

Comparison emulsion 2A

A solution of 40 g of inert bone gelatin in 2.0 1 of water is heated to 67° C. A solution of 340 g of silver nitrate in 2000 ml of water and a solution of 190 g of potassium bromide and 24 g of sodium chloride in 2000 ml of water are added during 80 minutes by the double jet process with vigorous stirring, the precipitation rate being 5 times higher at the end than at the beginning of precipitation. The pAg is maintained at 6.0 during precipitation. The emulsion is cooled to 40° C. and the pAg adjusted to 7.5 using potassium bromide. Ultrafiltration is used to concentrate the emulsion and to remove the soluble salts. After addition of 139 g of inert hide gelatin, the emulsion is adjusted to a silver content of 150 g (calculated as silver nitrate) per kilogram. 2.2 kg of emulsion are obtained. The halide composition is determined by X-ray diffraction and is found to be $AgBr_{0.80}Cl_{0.20}$; the average grain size, determined with an electrolytic grain size analyzer, is 0,63 μm with a coefficient of variation of 0.16.

A micrograph of the resultant emulsion, taken with a scanning electron microscope, shows that it contains exclusively crystals with a cubic habit. The emulsion is then optimally chemically ripened at 55° C. using 20 μmole of sodium thiosulphate and 10 μmole of potassium tetrachloroaurate per mole of silver halide and is spectrally sensitized with 300 mg of blue sensitizer BS 2 per mole of silver halide.

Emulsion according to the invention 2B

A solution of 90 g of inert hide gelatin in 4.5 1 of water is adjusted to pH 3.0 at 40° C. using nitric acid. A solution of 17 g of silver nitrate in 100 ml of water and a solution of 13 g of potassium bromide in 100 ml of water is added to this solution over 30 seconds by the double jet process with vigorous stirring, the pAg being maintained at 6.0.

The emulsion is then adjusted to pH 6.0 using sodium hydroxide solution, is heated to 75° C. and is stirred for 180 minutes. A solution of 340 g of silver nitrate in 2000 ml of water and a solution of 190 g of potassium bromide and 24 g of sodium chloride in 2000 ml of water are then added at a constant rate over 50 minutes by the double jet process, the pAg being maintained at 6.0. The emulsion is cooled to 40° C. and the pAg is adjusted to 7.5 using potassium bromide.

Ultrafiltration is used to concentrate the emulsion and to remove the soluble salts. After addition of 89 g of inert hide gelatin, the emulsion is adjusted to a silver content of 150 g (calculated as silver nitrate) per kilogram. 2.3 kg of emulsion are obtained. The halide composition is determined by x-ray diffraction and is found to be $AgBr_{0.80}Cl_{0.20}$; the average grain size, determined using an electrolytic grain size analyzer, is 0.63 μm with a coefficient of variation of 0.18. A micrograph of the resultant emulsion taken with a scanning electron microscope shows that is contains the triply twinned crystals described in FIG. 1 with (100)-surfaces in a content of more than 90% of all grains.

The emulsion is then optimally chemically ripened with 10 μmole of sodium thiosulphate and 10 μmole of potassium tetrachloroaurate per mole of silver halide at 55° C. and is spectrally sensitized using 300 mg of blue sensitizer BS 2 per mole of silver halide.

On a substrate consisting of paper coated on both sides with polyethylene there are applied:

1. A substrate layer of 200 mg/m$^2$ of gelatin with addition of $KNO_3$ and chrome alum.
2. An adhesive layer with 400 mg/m$^2$ of gelatin.
3. A light-sensitive layer of emulsion 2A and 2B with a coating weight of 2.5 g of $AgNO_3$/m$^3$ and 5.0 g of gelatin/m$^2$.
4. A protective layer of 1.0 g of gelatin/m$^2$.

The material is then hardened with formaldehyde.

After exposure using a step wedge with incandescent lamp light, a sample of the material is developed in the following developer:

| | |
|---|---|
| N-methyl-p-aminophenol | 1.0 g |
| Anhydrous sodium sulphite | 13.0 g |
| Hydroquinone | 3.0 g |
| Anhydrous sodium carbonate | 26.0 g |
| Potassium bromide | 1.0 g |
| | dissolved in 1 l of water |

The results shown in Table 1 are obtained.

TABLE 1

| Emulsion | Fog(S) | Sensitivity (E) | Slope (S) | Max. Density |
|---|---|---|---|---|
| 2A (Comp.) | 0.08 | 100 | 1.52 | 2.43 |
| 2B (Inv.) | 0.07 | 132 | 1.49 | 2.41 |

It can be seen that the emulsion according to the invention has substantially increased sensitivity in comparison with a monosized emulsion with untwinned crystals.

EXAMPLE 3

A substrate consisting of paper coated on both sides with polyethylene was provided with the following layers. The quantities relate to 1 m$^2$.

1. A substrate layer of 200 mg of gelatin with addition of $KNO_3$ and chrome alum.
2. An adhesive layer of 320 mg of gelatin.
3. A blue-sensitive silver bromidechloride emulsion layer (20 mole-% chloride) consisting of 450 mg of $AgNO_3$ with 1600 mg of gelatin, 1.0 mmole yellow coupler GB 12, 27.7 mg of 2,5-dioctylhydroquinone and 650 mg of tricresylphosphate.
4. An intermediate layer of 1200 g of gelatin, 80 mg of 2,5-dioctylhydroquinone and 100 mg of tricresylphosphate.
5. A green-sensitive silver bromidechloride emulsion layer (20 mole-% choride) consisting of 530 mg of $AgNO_3$ with 750 mg of gelatin, 0.625 mmole magenta coupler PP 3, 43 mg of 2,5-dioctylhydroquinone, 460 mg of dibutylphthalate and 43 mg of tricresylphosphate.
6. First UV-layer of 1550 mg of gelatin, 500 mg of UV-absorber corresponding to the formula:

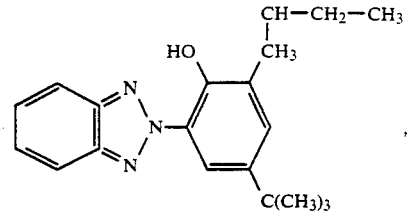

80 mg of dioctylhydroquinone and 650 mg of tricresylphosphate.

7. A red-sensitive silver bromide chloride emulsion layer (20 mol-% chloride) of 400 mg of $AgNo_3$ with 1470 mg of gelatin, 0.780 mmole cyan coupler BG 24, 285 mg of dibutylphthalate and 122 mg of tricresylphosphate.
8. Second UV-layer of 400 mg of gelatin, 134 mg of UV-absorber as in layer 6 and 240 mg of tricresylphosphate.
9. A protective layer of 1200 mg of gelatin and 400 mg of hardener corresponding to the formula:

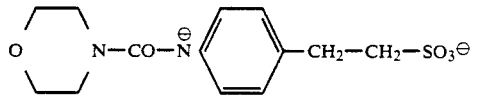

| | | |
|---|---|---|
| Color development | 33° C. | 3.5 minutes |
| Bleach fixing | 33° C. | 1.5 minutes |
| Washing | 33° C. | 3.0 minutes |

Developer 900 ml water
15 ml benzylalcohol
15 ml ethyleneglycol
3 g hydroxyamine sulphate
4.5 g 3-methyl-4-amino-N-ethyl-N-(β-methanesulphone amidoethyl)-aniline sulphate
32 g dry potassium carbonate
2 g dry potassium sulphite
0.6 g potassium bromide
1 g disodium salt of 1-hydroxyethylidine-1,1-diphosphonic acid
made up to 1 l with water and adjusted to pH 10.2.

Bleach fixing bath 700 ml water
35 ml ammonia solution (28% by weight)
30 g ethylenediamine-N,N,N',N'-tetraacetic acid
15 g dry sodium sulphite
100 g dry ammoniumthiosulphate
60 g sodium-(ethylenediaminetetraacetate)-iron-(III)-complex
made up to 1 l with water and adjusted to pH 7.

EXAMPLE 3a

The comparison emulsion 2A was introduced into the 3rd, 5th and 7th layer (comparison example).

EXAMPLE 3b

The emulsion 2B was introduced into the third layer (according to invention), and the emulsion 2A in the 5th and 7th layer.

The following sensitometric results were obtained:

| | S | | | E | | | S | | |
|---|---|---|---|---|---|---|---|---|---|
| | gb | pp | bg | gb | pp | bg | gb | pp | bg |
| 3a | 0.08 | 0.07 | 0.07 | 100 | 100 | 100 | 1.72 | 1.73 | 1.71 |
| 3b | 0.06 | 0.07 | 0.07 | 128 | 100 | 100 | 1.71 | 1.72 | 1.71 |

We claim

1. A photographic silver halide emulsion, of which at least 50% by weight of the silver halide crystals are triply twinned crystals with a crystal structure consisting of a basic tetrahedron with [111]-faces and three identical twinned regions, each of which has a [111]-twin face in common with the basic tetrahedron and is outwardly bounded by three [100]-faces and one [111]-face or by four [100]-faces, and of which any two respective regions are connected to each other by a common [411]-twin face, and whose grain size distribution has a coefficient of variation of at most 20%.

2. A silver halide emulsion according to claim 1, in which the ratio of the total crystal height to the height of the basic tetrahedron of the triply twinned crystals ranges from 1 to 5.

3. A silver halide emulsion according to claim 2, in which the ratio of heights ranges from 1.5 to 3.

4. A silver halide emulsion according to claim 1, wherein the emulsion is a silver bromide, silver bromide chloride, silver bromide iodide or silver bromide chloride iodide emulsion.

5. A silver halide emulsion according to claim 4, characterised in that the silver halide grains contain a silver bromide core.

6. A silver halide emulsion according to claim 1, characterised in that basic [111]-face of the basic tetrahedron is an external face or is overgrown by a triangular pyramid with [100]-faces.

7. A process for the production of emulsions according to claim 1, characterised in that nucleation is carried out at pAg of 5.5 to 6.5, pH<4 and a temperature of 20° to 50° C., physical ripening is carried out at a pAg of 6.0 to 7.0, pH of 4.0 to 8.0 and a temperature of 60° to 80° C. and further precipitation is carried out at a pAg of 6.0 to 7.0, pH of 4.0 to 8.0 and a temperature of 20° to 50° C.

8. A photographic material consisting of a substrate and at least one light-sensitive silver halide emulsion layer which is applied thereto and contains a silver halide emulsion according to claim 1.

* * * * *